US011059056B2

(12) United States Patent
Belongia

(10) Patent No.: US 11,059,056 B2
(45) Date of Patent: Jul. 13, 2021

(54) ROTARY STRIP NOZZLES AND DEFLECTORS

(71) Applicant: RAIN BIRD CORPORATION, Azusa, CA (US)

(72) Inventor: David Charles Belongia, Quail Creek, AZ (US)

(73) Assignee: RAIN BIRD CORPORATION, Azusa, CA (US)

( * ) Notice: Subject to any disclaimer, the term of this patent is extended or adjusted under 35 U.S.C. 154(b) by 113 days.

(21) Appl. No.: 16/289,252

(22) Filed: Feb. 28, 2019

(65) Prior Publication Data

US 2020/0276598 A1 Sep. 3, 2020

(51) Int. Cl.

| | |
|---|---|
| ***B05B 1/26*** | (2006.01) |
| ***B05B 3/04*** | (2006.01) |
| ***B05B 3/00*** | (2006.01) |
| ***B05B 1/30*** | (2006.01) |

(52) U.S. Cl.

CPC ..... *B05B 1/267* (2013.01); *B05B 1/304* (2013.01); *B05B 3/003* (2013.01); *B05B 3/0486* (2013.01)

(58) Field of Classification Search

CPC ..... B05B 1/267; B05B 1/304; B05B 3/003; B05B 3/0486

USPC ..... 239/222.11, 222.17, 231–233, 500–502, 239/504, 522

See application file for complete search history.

(56) References Cited

U.S. PATENT DOCUMENTS

| | | | |
|---|---|---|---|
| 458,607 | A | 9/1891 | Weiss |
| 581,252 | A | 4/1897 | Quayle |
| 598,873 | A | 2/1898 | Joy |
| 1,286,333 | A | 12/1918 | Johnson |
| 1,432,386 | A | 10/1922 | Ctjkwey |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

U.S. Appl. No. 15/473,036; Office Action dated Jan. 13, 2020; (pp. 1-9).

(Continued)

*Primary Examiner* — Steven J Ganey

(74) *Attorney, Agent, or Firm* — Fitch, Even, Tabin & Flannery LLP

(57) ABSTRACT

Rotary nozzles are provided that produce multiple discrete water streams for the irrigation of a substantially rectangular irrigation area. The nozzles may be designed to function as one of a left corner strip nozzle, right corner strip nozzle, and side strip nozzle. Each nozzle includes a particular type of nozzle housing with multiple flow channels oriented to irrigate a rectangular area in a certain position relative to the nozzle. The side strip nozzle includes one or more groups of two flow channels that are asymmetric with respect to one another. Further, each nozzle includes a deflector that rotates in either a clockwise or counterclockwise direction, depending on the position of the rectangular irrigation area relative to the nozzle. By matching deflector rotation with the position of the rectangular irrigation area, the uniformity of irrigation within the rectangular irrigation area can be increased.

21 Claims, 14 Drawing Sheets

(56) References Cited

U.S. PATENT DOCUMENTS

| | | | |
|---|---|---|---|
| 1,523,609 | A | 1/1925 | Roach |
| 1,964,225 | A | 6/1934 | Sumner |
| 2,025,063 | A | 12/1935 | Loepsinger |
| 2,075,589 | A | 3/1937 | Munz |
| 2,125,863 | A | 8/1938 | Arbogast |
| 2,125,978 | A | 8/1938 | Arbogast |
| 2,128,552 | A | 8/1938 | Rader |
| 2,130,810 | A | 9/1938 | Munz |
| 2,135,138 | A | 11/1938 | Horace |
| 2,325,280 | A | 7/1943 | Scherrer |
| 2,348,776 | A | 5/1944 | Bentley |
| 2,315,598 | A | 7/1950 | Harvey |
| 2,634,163 | A | 4/1953 | Double |
| 2,723,879 | A | 11/1955 | Martin |
| 2,785,013 | A | 3/1957 | Stearns |
| 2,875,783 | A | 3/1959 | Schippers |
| 2,914,257 | A | 11/1959 | Wiant |
| 2,935,266 | A | 5/1960 | Coleondro |
| 2,990,123 | A | 6/1961 | Hyde |
| 2,990,128 | A | 6/1961 | Knutsen |
| 3,029,030 | A | 4/1962 | Dey, Sr. |
| 3,030,032 | A | 4/1962 | Juhman, Jr. |
| 3,109,591 | A | 11/1963 | Moen |
| 3,239,149 | A | 3/1966 | Lindberg, Jr. |
| 3,380,659 | A | 4/1968 | Seablom |
| 3,424,381 | A | 1/1969 | Best |
| 3,528,093 | A | 9/1970 | Eerkens |
| 3,752,403 | A | 8/1973 | Van Diest |
| 3,854,664 | A | 12/1974 | Hunter |
| 3,955,764 | A | 5/1976 | Phaup |
| 4,026,471 | A | 5/1977 | Hunter |
| 4,099,675 | A | 7/1978 | Wohler |
| 4,119,275 | A | 10/1978 | Hunter |
| 4,131,234 | A | 12/1978 | Pescetto |
| 4,180,210 | A | 12/1979 | Dewitt |
| 4,189,099 | A | 2/1980 | Bruninga |
| 4,198,000 | A | 4/1980 | Hunter |
| 4,235,379 | A | 11/1980 | Beamer |
| 4,253,608 | A | 3/1981 | Hunter |
| 4,261,515 | A | 4/1981 | Rosenberg |
| 4,269,354 | A | 5/1981 | Dewitt |
| 4,272,024 | A | 6/1981 | Kah |
| 4,281,793 | A | 8/1981 | Dewitt |
| 4,316,579 | A | 2/1982 | Ray |
| 4,353,506 | A | 10/1982 | Hayes |
| 4,353,507 | A | 10/1982 | Kah |
| 4,398,666 | A | 8/1983 | Hunter |
| 4,417,691 | A | 11/1983 | Lockwood |
| 4,456,181 | A | 6/1984 | Burnham |
| 4,471,908 | A | 9/1984 | Hunter |
| 4,479,611 | A | 10/1984 | Galvis |
| 4,501,391 | A | 2/1985 | Hunter |
| 4,512,519 | A | 4/1985 | Uzrad |
| 4,540,125 | A | 9/1985 | Gorney |
| 4,566,632 | A | 1/1986 | Sesser |
| 4,568,024 | A | 2/1986 | Hunter |
| 4,579,284 | A | 4/1986 | Arnold |
| 4,579,285 | A | 4/1986 | Hunter |
| 4,609,146 | A | 9/1986 | Walto |
| 4,618,100 | A | 10/1986 | White |
| 4,624,412 | A | 11/1986 | Hunter |
| 4,625,917 | A | 12/1986 | Torney |
| 4,632,312 | A | 12/1986 | Premo |
| RE32,386 | E | 3/1987 | Hunter |
| 4,660,766 | A | 4/1987 | Nelson |
| 4,669,663 | A | 6/1987 | Meyer |
| 4,676,438 | A | 6/1987 | Sesser |
| 4,681,260 | A | 7/1987 | Cochran |
| 4,681,263 | A | 7/1987 | Cockman |
| 4,682,732 | A | 7/1987 | Walto |
| 4,699,321 | A | 10/1987 | Bivens |
| 4,708,291 | A | 11/1987 | Grundy |
| 4,711,399 | A | 12/1987 | Rosenberg |
| 4,718,605 | A | 1/1988 | Hunter |
| 4,720,045 | A | 1/1988 | Meyer |
| 4,728,040 | A | 3/1988 | Healy |
| 4,739,394 | A | 4/1988 | Oda |
| 4,739,934 | A | 4/1988 | Gewelber |
| D296,464 | S | 6/1988 | Marmol |
| 4,752,031 | A | 6/1988 | Merrick |
| 4,754,925 | A | 7/1988 | Rubinstein |
| 4,760,958 | A | 8/1988 | Greenberg |
| 4,763,838 | A | 8/1988 | Holcomb |
| 4,783,004 | A | 11/1988 | Lockwood |
| 4,784,325 | A | 11/1988 | Walker |
| 4,796,809 | A | 1/1989 | Hunter |
| 4,796,811 | A | 1/1989 | Davisson |
| 4,815,662 | A | 3/1989 | Hunter |
| 4,817,869 | A | 4/1989 | Rubinstein |
| 4,832,264 | A | 5/1989 | Rosenberg |
| 4,834,289 | A | 5/1989 | Hunter |
| 4,836,449 | A | 6/1989 | Hunter |
| 4,836,450 | A | 6/1989 | Hunter |
| 4,840,312 | A | 6/1989 | Tyler |
| 4,842,201 | A | 6/1989 | Hunter |
| 4,867,378 | A | 9/1989 | Kah |
| 4,867,379 | A | 9/1989 | Hunter |
| 4,898,332 | A | 2/1990 | Hunter |
| 4,901,924 | A | 2/1990 | Kah |
| 4,932,590 | A | 6/1990 | Hunter |
| 4,944,456 | A | 7/1990 | Zakai |
| 4,948,052 | A | 8/1990 | Hunter |
| 4,955,542 | A | 9/1990 | Kah |
| 4,957,240 | A | 9/1990 | Rosenberg |
| 4,961,534 | A | 10/1990 | Tyler |
| 4,967,961 | A | 11/1990 | Hunter |
| 4,971,250 | A | 11/1990 | Hunter |
| D312,865 | S | 12/1990 | Davisson |
| 4,986,474 | A | 1/1991 | Schisler |
| 5,031,840 | A | 7/1991 | Grundy |
| 5,050,800 | A | 9/1991 | Lamar |
| 5,052,621 | A | 10/1991 | Katzer |
| 5,058,806 | A | 10/1991 | Rupar |
| 5,078,321 | A | 1/1992 | Davis |
| 5,083,709 | A | 1/1992 | Iwanowski |
| RE33,823 | E | 2/1992 | Nelson |
| 5,086,977 | A | 2/1992 | Kah |
| 5,090,619 | A | 2/1992 | Berthold |
| 5,098,021 | A | 3/1992 | Kah |
| 5,104,045 | A | 4/1992 | Kah |
| 5,123,597 | A | 6/1992 | Bendall |
| 5,141,024 | A | 8/1992 | Hicks |
| 5,143,657 | A | 9/1992 | Curtis |
| 5,148,990 | A | 9/1992 | Kah |
| 5,148,991 | A | 9/1992 | Kah |
| 5,152,458 | A | 10/1992 | Curtis |
| 5,158,232 | A | 10/1992 | Tyler |
| 5,174,501 | A | 12/1992 | Hadar |
| 5,199,646 | A | 4/1993 | Kah |
| 5,205,491 | A | 4/1993 | Hadar |
| 5,224,653 | A | 7/1993 | Nelson |
| 5,226,599 | A | 7/1993 | Lindermeir |
| 5,226,602 | A | 7/1993 | Cochran |
| 5,234,169 | A | 8/1993 | McKenzie |
| 5,240,182 | A | 8/1993 | Lemme |
| 5,240,184 | A | 8/1993 | Lawson |
| 5,267,689 | A | 12/1993 | Forer |
| 5,288,022 | A | 2/1994 | Sesser |
| 5,299,742 | A | 4/1994 | Han |
| 5,322,223 | A | 6/1994 | Hadar |
| 5,335,857 | A | 8/1994 | Hagon |
| 5,360,167 | A | 11/1994 | Grundy |
| 5,370,311 | A | 12/1994 | Chen |
| 5,372,307 | A | 12/1994 | Sesser |
| 5,375,768 | A | 12/1994 | Clark |
| 5,381,960 | A | 1/1995 | Sullivan |
| 5,398,872 | A | 3/1995 | Joubran |
| 5,415,348 | A | 5/1995 | Nelson |
| 5,417,370 | A | 5/1995 | Kah |
| 5,423,486 | A | 6/1995 | Hunter |
| 5,435,490 | A | 7/1995 | Machut |
| 5,439,174 | A | 8/1995 | Sweet |
| RE35,037 | E | 9/1995 | Kah |
| 5,456,411 | A | 10/1995 | Scott |

(56) References Cited

U.S. PATENT DOCUMENTS

| | | | |
|---|---|---|---|
| 5,503,139 | A | 4/1996 | McMahon |
| 5,526,982 | A | 6/1996 | McKenzie |
| 5,544,814 | A | 8/1996 | Spenser |
| 5,556,036 | A | 9/1996 | Chase |
| 5,588,594 | A | 12/1996 | Kah |
| 5,588,595 | A | 12/1996 | Sweet |
| 5,598,977 | A | 2/1997 | Lemme |
| 5,611,488 | A | 3/1997 | Frolich |
| 5,620,141 | A | 4/1997 | Chiang |
| 5,640,983 | A | 6/1997 | Sherman |
| 5,642,861 | A | 7/1997 | Ogi |
| 5,653,390 | A | 8/1997 | Kah |
| 5,662,545 | A | 9/1997 | Zimmerman |
| 5,669,449 | A | 9/1997 | Polan |
| 5,671,885 | A | 9/1997 | Davisson |
| 5,671,886 | A | 9/1997 | Sesser |
| 5,676,315 | A | 10/1997 | Han |
| D388,502 | S | 12/1997 | Kah |
| 5,695,123 | A | 12/1997 | Le |
| 5,699,962 | A | 12/1997 | Scott |
| 5,711,486 | A | 1/1998 | Clark |
| 5,718,381 | A | 2/1998 | Katzer |
| 5,720,435 | A | 2/1998 | Hunter |
| 5,722,593 | A | 3/1998 | McKenzie |
| 5,758,827 | A | 6/1998 | Van Le |
| 5,762,269 | A | 6/1998 | Sweet |
| 5,762,270 | A | 6/1998 | Kearby |
| 5,765,757 | A | 6/1998 | Bendall |
| 5,765,760 | A | 6/1998 | Kuo |
| 5,769,322 | A | 6/1998 | Smith |
| 5,785,248 | A | 7/1998 | Staylor |
| 5,820,029 | A | 10/1998 | Marans |
| 5,823,439 | A | 10/1998 | Hunter |
| 5,823,440 | A | 10/1998 | Clark |
| 5,826,797 | A | 10/1998 | Kah |
| 5,845,849 | A | 12/1998 | Mitzlaff |
| 5,875,969 | A | 3/1999 | Grundy |
| 5,918,812 | A | 7/1999 | Beutler |
| 5,927,607 | A | 7/1999 | Scott |
| 5,971,297 | A | 10/1999 | Sesser |
| 5,988,523 | A | 11/1999 | Scott |
| 5,992,760 | A | 11/1999 | Kearby |
| 6,007,001 | A | 12/1999 | Hilton |
| 6,019,295 | A | 2/2000 | McKenzie |
| 6,029,907 | A | 2/2000 | McKenzie |
| 6,042,021 | A | 3/2000 | Clark |
| 6,050,502 | A | 4/2000 | Clark |
| 6,059,044 | A | 5/2000 | Fischer |
| 6,076,744 | A | 6/2000 | O'Brien |
| 6,076,747 | A | 6/2000 | Ming-Yuan |
| 6,085,995 | A | 7/2000 | Kah |
| 6,092,739 | A | 7/2000 | Clearman |
| 6,102,308 | A | 8/2000 | Steingass |
| 6,109,545 | A | 8/2000 | Kah |
| 6,123,272 | A | 9/2000 | Havican |
| 6,138,924 | A | 10/2000 | Hunter |
| 6,145,758 | A | 11/2000 | Ogi |
| 6,155,493 | A | 12/2000 | Kearby |
| 6,158,675 | A | 12/2000 | Ogi |
| 6,182,909 | B1 | 2/2001 | Kah |
| 6,186,413 | B1 | 2/2001 | Lawson |
| 6,223,999 | B1 | 5/2001 | Lemelshtrich |
| 6,227,455 | B1 | 5/2001 | Scott |
| 6,230,988 | B1 | 5/2001 | Chao |
| 6,230,989 | B1 | 5/2001 | Haverstraw |
| 6,234,411 | B1 | 5/2001 | Walker |
| 6,237,862 | B1 | 5/2001 | Kah |
| 6,241,158 | B1 | 6/2001 | Clark |
| 6,244,521 | B1 | 6/2001 | Sesser |
| 6,254,013 | B1 | 7/2001 | Clearman |
| 6,264,117 | B1 | 7/2001 | Roman |
| 6,267,299 | B1 | 7/2001 | Meyer |
| 6,276,460 | B1 | 8/2001 | Pahila |
| 6,286,767 | B1 | 9/2001 | Hui-Chen |
| 6,332,581 | B1 | 12/2001 | Chin |
| 6,336,597 | B1 | 1/2002 | Kah |
| 6,341,733 | B1 | 1/2002 | Sweet |
| 6,345,541 | B1 | 2/2002 | Hendey |
| 6,367,708 | B1 | 4/2002 | Olson |
| D458,342 | S | 6/2002 | Johnson |
| 6,435,427 | B1 | 8/2002 | Conroy |
| 6,439,477 | B1 | 8/2002 | Sweet |
| 6,443,372 | B1 | 9/2002 | Hsu |
| 6,454,186 | B2 | 9/2002 | Haverstraw |
| 6,457,656 | B1 | 10/2002 | Scott |
| 6,464,151 | B1 | 10/2002 | Cordua |
| 6,478,237 | B2 | 11/2002 | Kearby |
| 6,481,644 | B1 | 11/2002 | Olsen |
| 6,488,218 | B1 | 12/2002 | Townsend |
| 6,491,235 | B1 | 12/2002 | Scott |
| 6,494,384 | B1 | 12/2002 | Meyer |
| 6,499,672 | B1 | 12/2002 | Sesser |
| 6,516,893 | B2 | 2/2003 | Pahila |
| 6,530,531 | B2 | 3/2003 | Butler |
| 6,601,781 | B2 | 8/2003 | Kah |
| 6,607,147 | B2 | 8/2003 | Schneider |
| 6,622,940 | B2 | 9/2003 | Huang |
| 6,637,672 | B2 | 10/2003 | Cordua |
| 6,651,904 | B2 | 11/2003 | Roman |
| 6,651,905 | B2 | 11/2003 | Sesser |
| 6,688,539 | B2 | 2/2004 | Vander Griend |
| 6,695,223 | B2 | 2/2004 | Beutler |
| 6,715,699 | B1 | 4/2004 | Greenberg |
| 6,719,218 | B2 | 4/2004 | Cool |
| 6,732,952 | B2 | 5/2004 | Kah |
| 6,736,332 | B2 | 5/2004 | Sesser |
| 6,736,336 | B2 | 5/2004 | Wong |
| 6,737,332 | B1 | 5/2004 | Fuselier |
| 6,769,633 | B1 | 8/2004 | Huang |
| 6,811,098 | B2 | 11/2004 | Drechsel |
| 6,814,304 | B2 | 11/2004 | Onofrio |
| 6,814,305 | B2 | 11/2004 | Townsend |
| 6,817,543 | B2 | 11/2004 | Clark |
| 6,820,825 | B1 | 11/2004 | Wang |
| 6,827,291 | B2 | 12/2004 | Townsend |
| 6,834,816 | B2 | 12/2004 | Kah, Jr. |
| 6,840,460 | B2 | 1/2005 | Clark |
| 6,848,632 | B2 | 2/2005 | Clark |
| 6,854,664 | B2 | 2/2005 | Smith |
| 6,869,026 | B2 | 3/2005 | McKenzie |
| 6,871,795 | B2 | 3/2005 | Anuskiewicz |
| 6,880,768 | B2 | 4/2005 | Lau |
| 6,883,727 | B2 | 4/2005 | De Los Santos |
| 6,921,030 | B2 | 7/2005 | Renquist |
| 6,942,164 | B2 | 9/2005 | Walker |
| 6,945,471 | B2 | 9/2005 | McKenzie |
| 6,957,782 | B2 | 10/2005 | Clark |
| 6,976,543 | B1 | 12/2005 | Fischer |
| 6,997,393 | B1 | 2/2006 | Angold |
| 7,017,831 | B2 | 3/2006 | Santiago |
| 7,017,837 | B2 | 3/2006 | Taketomi |
| 7,028,920 | B2 | 4/2006 | Hekman |
| 7,028,927 | B2 | 4/2006 | Mermet |
| 7,032,836 | B2 | 4/2006 | Sesser |
| 7,032,844 | B2 | 4/2006 | Cordua |
| 7,040,553 | B2 | 5/2006 | Clark |
| 7,044,403 | B2 | 5/2006 | Kah |
| 7,070,122 | B2 | 7/2006 | Burcham |
| 7,090,146 | B1 | 8/2006 | Ericksen |
| 7,100,842 | B2 | 9/2006 | Meyer |
| 7,104,472 | B2 | 9/2006 | Renquist |
| 7,111,795 | B2 | 9/2006 | Thong |
| 7,143,957 | B2 | 12/2006 | Nelson |
| 7,143,962 | B2 | 12/2006 | Kah, Jr. |
| 7,152,814 | B1 | 12/2006 | Schapper |
| 7,156,322 | B1 | 1/2007 | Heitzman |
| 7,159,795 | B2 | 1/2007 | Sesser |
| 7,168,634 | B2 | 1/2007 | Onofrio |
| 7,232,081 | B2 | 6/2007 | Kah |
| 7,234,651 | B2 | 6/2007 | Mousavi |
| 7,240,860 | B2 | 7/2007 | Griend |
| 7,287,711 | B2 | 10/2007 | Crooks |
| 7,293,721 | B2 | 11/2007 | Roberts |
| 7,303,147 | B1 | 12/2007 | Danner |

(56) References Cited

U.S. PATENT DOCUMENTS 7,303,153 B2 12/2007 Han
7,322,533 B2 1/2008 Grizzle
7,337,988 B2 3/2008 McCormick
7,389,942 B2 6/2008 Kenyon
RE40,440 E 7/2008 Sesser
7,392,956 B2 7/2008 McKenzie
7,395,977 B2 7/2008 Pinch
7,429,005 B2 9/2008 Schapper
7,478,526 B2 1/2009 McAfee
7,533,833 B2 5/2009 Wang
7,581,687 B2 9/2009 Feith
7,584,904 B2 9/2009 Townsend
7,584,906 B2 9/2009 Lev
7,597,273 B2 10/2009 McAfee
7,597,276 B2 10/2009 Hawkins
7,607,588 B2 10/2009 Nobili
7,611,077 B2 11/2009 Sesser
7,621,467 B1 11/2009 Garcia
7,624,935 B2 12/2009 Nelson
7,654,474 B2 2/2010 Cordua
7,686,235 B2 3/2010 Roberts
7,686,236 B2 3/2010 Alexander
7,703,706 B2 4/2010 Walker
D615,152 S 5/2010 Kah
7,717,361 B2 5/2010 Nelson
7,766,259 B2 8/2010 Feith
D628,272 S 11/2010 Kah
7,828,229 B2 11/2010 Kah
7,850,094 B2 12/2010 Richmond
7,861,948 B1 1/2011 Crooks
D636,459 S 4/2011 Kah
7,926,746 B2 4/2011 Melton
7,942,345 B2 5/2011 Sesser
7,971,804 B2 7/2011 Roberts
7,980,488 B2 7/2011 Townsend
RE42,596 E 8/2011 Sesser
7,988,071 B2 8/2011 Bredberg
8,006,919 B2 8/2011 Renquist
8,011,602 B2 9/2011 Coppersmith
8,028,932 B2 10/2011 Sesser
8,047,456 B2 11/2011 Kah
8,056,829 B2 11/2011 Gregory
8,074,897 B2 12/2011 Hunnicutt
8,205,811 B2 6/2012 Cordua
8,272,578 B1 9/2012 Clark
8,272,583 B2 9/2012 Hunnicutt
8,282,022 B2 10/2012 Porter
8,328,117 B2 12/2012 Bredberg
8,540,171 B2 9/2013 Renquist
8,567,691 B2 10/2013 Townsend
8,567,697 B2 10/2013 Bredberg
8,567,699 B2 10/2013 Sesser
8,602,325 B2 12/2013 Clark
8,651,400 B2 2/2014 Walker
8,672,242 B2 3/2014 Hunnicutt
8,695,900 B2 4/2014 Hunnicutt
8,783,582 B2 7/2014 Robertson
8,789,768 B2 7/2014 Hunnicutt
8,893,986 B2 11/2014 Kah, Jr.
8,925,837 B2 1/2015 Walker
8,991,724 B2 3/2015 Sesser
8,991,726 B2 3/2015 Kah, Jr.
8,991,730 B2 3/2015 Kah, Jr.
9,056,214 B2 6/2015 Barmoav
9,079,202 B2 7/2015 Walker
9,174,227 B2 11/2015 Robertson
9,179,612 B2 11/2015 Nelson
9,248,459 B2 2/2016 Kah, Jr.
9,295,998 B2 3/2016 Shadbolt
9,314,952 B2 4/2016 Walker
9,327,297 B2 5/2016 Walker
9,387,496 B2 7/2016 Kah, III
9,427,751 B2 8/2016 Kim
9,492,832 B2 11/2016 Kim
9,504,209 B2 11/2016 Kim
9,555,422 B2 1/2017 Zhao
9,669,420 B2 6/2017 Heren
9,757,743 B2 9/2017 Kah, Jr.
9,776,195 B2 10/2017 Russell
9,808,813 B1 11/2017 Porter
9,937,513 B2 4/2018 Kah, III
9,981,276 B2 5/2018 Kah, Jr.
9,987,639 B2 6/2018 Russell
10,092,913 B2 10/2018 Gopalan
10,201,818 B2 2/2019 Duffin
10,213,802 B2 2/2019 Kah, Jr.
10,232,388 B2 3/2019 Glezerman
10,232,389 B1 3/2019 Forrest
10,239,067 B2 3/2019 Glezerman
10,322,422 B2 6/2019 Simmons
10,322,423 B2 6/2019 Walker
2001/0023901 A1 9/2001 Haverstraw
2002/0070289 A1 6/2002 Hsu
2002/0130202 A1 9/2002 Kah
2002/0139868 A1 10/2002 Sesser
2002/0153434 A1 10/2002 Cordua
2003/0006304 A1 1/2003 Cool
2003/0015606 A1 1/2003 Cordua
2003/0042327 A1 3/2003 Beutler
2003/0071140 A1 4/2003 Roman
2003/0075620 A1 4/2003 Kah, Jr.
2004/0108391 A1 6/2004 Onofrio
2005/0006501 A1 1/2005 Englefield
2005/0161534 A1 7/2005 Kah
2005/0194464 A1 9/2005 Bruninga
2005/0194479 A1 9/2005 Curtis
2006/0038046 A1 2/2006 Curtis
2006/0086832 A1 4/2006 Roberts
2006/0086833 A1 4/2006 Roberts
2006/0108445 A1 5/2006 Pinch
2006/0144968 A1 7/2006 Lev
2006/0150899 A1* 7/2006 Han ..... B05B 1/14
239/504
2006/0237198 A1 10/2006 Crampton
2006/0273202 A1 12/2006 Su
2006/0281375 A1 12/2006 Jordan
2007/0012800 A1 1/2007 McAfee
2007/0034711 A1 2/2007 Kah
2007/0034712 A1 2/2007 Kah
2007/0119975 A1 5/2007 Hunnicutt
2007/0181711 A1 8/2007 Sesser
2007/0210188 A1 9/2007 Schapper
2007/0235565 A1 10/2007 Kah
2007/0246567 A1 10/2007 Roberts
2008/0087743 A1 4/2008 Govrin
2008/0169363 A1 7/2008 Walker
2008/0217427 A1 9/2008 Wang
2008/0257982 A1 10/2008 Kah
2008/0276391 A1 11/2008 Jung
2008/0277499 A1 11/2008 McAfee
2009/0008484 A1 1/2009 Feith
2009/0014559 A1 1/2009 Marino
2009/0072048 A1 3/2009 Renquist
2009/0078788 A1 3/2009 Holmes
2009/0108099 A1 4/2009 Porter
2009/0140076 A1 6/2009 Cordua
2009/0173803 A1 7/2009 Kah
2009/0173904 A1 7/2009 Roberts
2009/0188988 A1 7/2009 Walker
2009/0224070 A1 9/2009 Clark
2010/0078508 A1 4/2010 South
2010/0090024 A1 4/2010 Hunnicutt
2010/0108787 A1 5/2010 Walker
2010/0176217 A1 7/2010 Richmond
2010/0257670 A1 10/2010 Hodel
2010/0276512 A1 11/2010 Nies
2010/0301135 A1 12/2010 Hunnicutt
2010/0301142 A1 12/2010 Hunnicutt
2011/0024522 A1 2/2011 Anuskiewicz
2011/0089250 A1 4/2011 Zhao
2011/0121097 A1 5/2011 Walker
2011/0147484 A1 6/2011 Jahan
2011/0248093 A1 10/2011 Kim
2011/0248094 A1 10/2011 Robertson

(56) References Cited

U.S. PATENT DOCUMENTS

| | | | |
|---|---|---|---|
| 2011/0248097 | A1 | 10/2011 | Kim |
| 2011/0309161 | A1 | 12/2011 | Renquist |
| 2012/0012670 | A1 | 1/2012 | Kah |
| 2012/0061489 | A1 | 3/2012 | Hunnicutt |
| 2012/0153051 | A1 | 6/2012 | Kah |
| 2012/0273592 | A1 | 11/2012 | Zhang |
| 2012/0292403 | A1 | 11/2012 | Hunnicutt |
| 2013/0043050 | A1 | 2/2013 | Barmoav |
| 2013/0334332 | A1 | 12/2013 | Robertson |
| 2013/0334340 | A1 | 12/2013 | Walker |
| 2014/0027526 | A1 | 1/2014 | Shadbolt |
| 2014/0027527 | A1 | 1/2014 | Walker |
| 2014/0042251 | A1 | 2/2014 | Maksymec |
| 2014/0110501 | A1 | 4/2014 | Lawyer |
| 2014/0224900 | A1 | 8/2014 | Kim |
| 2014/0263735 | A1 | 9/2014 | Nations |
| 2014/0339334 | A1 | 11/2014 | Kah |
| 2015/0076253 | A1 | 3/2015 | Kah, Jr. |
| 2015/0083828 | A1 | 3/2015 | Maksymec |
| 2015/0144716 | A1 | 5/2015 | Barmoav |
| 2015/0158036 | A1 | 6/2015 | Kah, Jr. |
| 2015/0165455 | A1 | 6/2015 | Kah |
| 2015/0273492 | A1 | 10/2015 | Barmoav |
| 2015/0321207 | A1 | 11/2015 | Kah |
| 2017/0056899 | A1 | 3/2017 | Kim |
| 2017/0128963 | A1 | 5/2017 | Liln |
| 2017/0203311 | A1 | 7/2017 | Kim |
| 2017/0348709 | A1 | 12/2017 | Kah, Jr. |
| 2018/0015487 | A1 | 1/2018 | Russell |
| 2018/0058684 | A1 | 3/2018 | Qiu |
| 2018/0141060 | A1 | 5/2018 | Walker |
| 2018/0221895 | A1 | 8/2018 | McCarty |
| 2018/0250692 | A1 | 9/2018 | Kah, Jr. |
| 2018/0257093 | A1 | 9/2018 | Glezerman |
| 2018/0280994 | A1 | 10/2018 | Walker |
| 2018/0311684 | A1 | 11/2018 | Lawyer |
| 2019/0015849 | A1 | 1/2019 | Geerligs |
| 2019/0022442 | A1 | 1/2019 | Jimenez |
| 2019/0054480 | A1 | 2/2019 | Sesser |
| 2019/0054481 | A1 | 2/2019 | Sesser |
| 2019/0118195 | A1 | 4/2019 | Geerligs |
| 2019/0133059 | A1 | 5/2019 | DeWitt |
| 2019/0143361 | A1 | 5/2019 | Kah, Jr. |
| 2019/0193095 | A1 | 6/2019 | Sesser |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| DE | 19925279 | | 12/1999 |
| EP | 0463742 | | 1/1992 |
| EP | 0489679 | | 6/1992 |
| EP | 0518579 | | 12/1992 |
| EP | 0572747 | | 12/1993 |
| EP | 0646417 | | 4/1995 |
| EP | 0724913 | A2 | 8/1996 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| FR | 2730901 | | 9/1997 |
| GB | 908314 | | 10/1962 |
| GB | 1234723 | | 6/1971 |
| GB | 2330783 | | 5/1999 |
| IL | 35182 | | 4/1973 |
| WO | 1995020988 | | 8/1995 |
| WO | 1997027951 | | 8/1997 |
| WO | 9735668 | | 10/1997 |
| WO | 2000007428 | | 12/2000 |
| WO | 200131996 | | 5/2001 |
| WO | 2001031996 | | 5/2001 |
| WO | 200162395 | | 8/2001 |
| WO | 2001062395 | | 8/2001 |
| WO | 2002078857 | | 10/2002 |
| WO | 2002098570 | | 12/2002 |
| WO | 2003086643 | | 10/2003 |
| WO | 2004052721 | | 6/2004 |
| WO | 2005099905 | | 10/2005 |
| WO | 2005115554 | | 12/2005 |
| WO | 2005123263 | | 12/2005 |
| WO | 2006108298 | | 10/2006 |
| WO | 2007131270 | | 11/2007 |
| WO | 2008130393 | | 10/2008 |
| WO | 2009036382 | | 3/2009 |
| WO | 2010036241 | | 4/2010 |
| WO | 2010126769 | | 11/2010 |
| WO | 2011075690 | | 6/2011 |
| WO | 2014018892 | | 1/2014 |

OTHER PUBLICATIONS

U.S. Appl. No. 15/473,036; Office Action dated Jul. 29, 2020, (pp. 1-8).

U.S. Appl. No. 15/473,036; Office Action dated Dec. 10, 2020; (pp. 1-9).

* cited by examiner

ROTARY STRIP NOZZLES AND DEFLECTORS

FIELD

The invention relates to irrigation nozzles and, more particularly, to rotary nozzles and deflectors for distribution of water in strip irrigation patterns.

BACKGROUND

Nozzles are commonly used for the irrigation of landscape and vegetation. In a typical irrigation system, various types of nozzles are used to distribute water over a desired area. One type of irrigation nozzle is the rotary nozzle (or rotating stream type) having a rotatable deflector with flutes for producing a plurality of relatively small water streams swept over a surrounding terrain area to irrigate adjacent vegetation.

Rotary nozzles of the type having a rotatable deflector with flutes for producing a plurality of relatively small outwardly projected water streams are known in the art. In such nozzles, water is directed upwardly against a rotatable deflector having a lower surface with curved flutes defining an array of relatively small flow channels extending upwardly and turning radially outwardly with a spiral component of direction. The water impinges upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range and trajectory of throw depending, in part, on the inclination and other geometry of the individual flutes.

In some applications, it is desirable to be able to use rotary nozzles for irrigating a rectangular area of the terrain. Specialty nozzles have been developed for irrigating terrain having specific geometries, such as rectangular strips, and some of these specialty nozzles are referred to as left corner strip, right corner strip, and side strip nozzles. Some of these specialty nozzles, however, do not cover the desired strip pattern accurately. They may not cover the entire desired pattern or may also irrigate additional terrain surrounding the desired strip pattern.

Accordingly, a need exists for a nozzle that can accurately irrigate a desired strip pattern. In other words, a need exists to provide relatively uniform irrigation within the desired strip pattern so as not to leave areas that do not receive enough water and so as not to distribute water outside of the desired strip pattern. Further, there is a need for a specialty nozzle that provides irrigation of strip patterns having different geometries and positions relative to the nozzle.

DESCRIPTION OF THE PREFERRED EMBODIMENTS

Figure 1:
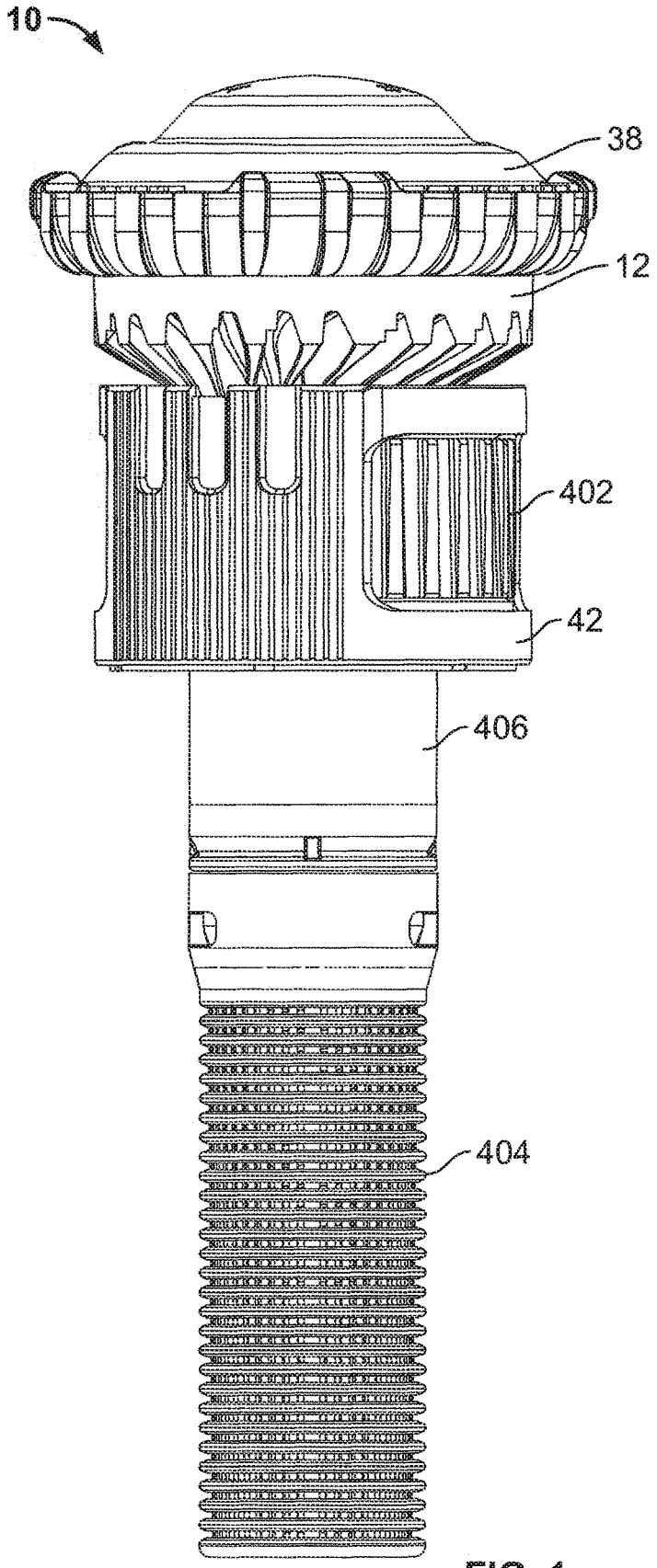
FIG. 1 is a perspective view of an embodiment of a nozzle embodying features of the present invention.

FIGS. 1-4B show an embodiment of a rotary nozzle 10 that may include certain components to allow for side strip, left corner strip, or right corner strip irrigation. As described in more detail below, left corner strip refers to a rectangular irrigation area where the nozzle is at a left corner of the pattern, right corner strip refers to a rectangular irrigation area where the nozzle is at a right corner of the pattern, and side strip refers to a rectangular irrigation area that extends to both sides of the nozzle 10. The rotary nozzle 10 may be customized for left corner strip, right corner strip, and side strip irrigation by replacing and matching the nozzle housing and deflector of the nozzle 10, as addressed further below.

Some of the structural components of the nozzle 10 are similar to those described in U.S. Pat. Nos. 9,295,998 and 9,327,297, in U.S. Publication No. 2018/0141060, and in U.S. Publication No. 2019/0015849. These patents and applications are assigned to the assignee of the present application and are incorporated herein by reference in their entirety. These components are provided for an understanding of the various aspects of one embodiment, but as should be understood, not all of these components are required for operation of other embodiments within the scope of this disclosure. For example, it is generally contemplated that the pattern templates and deflectors described herein may be used with other types of components.

As can be seen in FIGS. 1-4B, the nozzle 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 17. The water preferably passes through an inlet 412 controlled by a radius adjustment feature that regulates the amount of fluid flow through the nozzle body 17. Water is then directed generally upwardly through the pattern template 14 (or pattern member(s)) to produce upwardly directed water streams or jets that impinge the underside surface of a deflector 12 for rotatably driving the deflector 12.

Figure 4A:
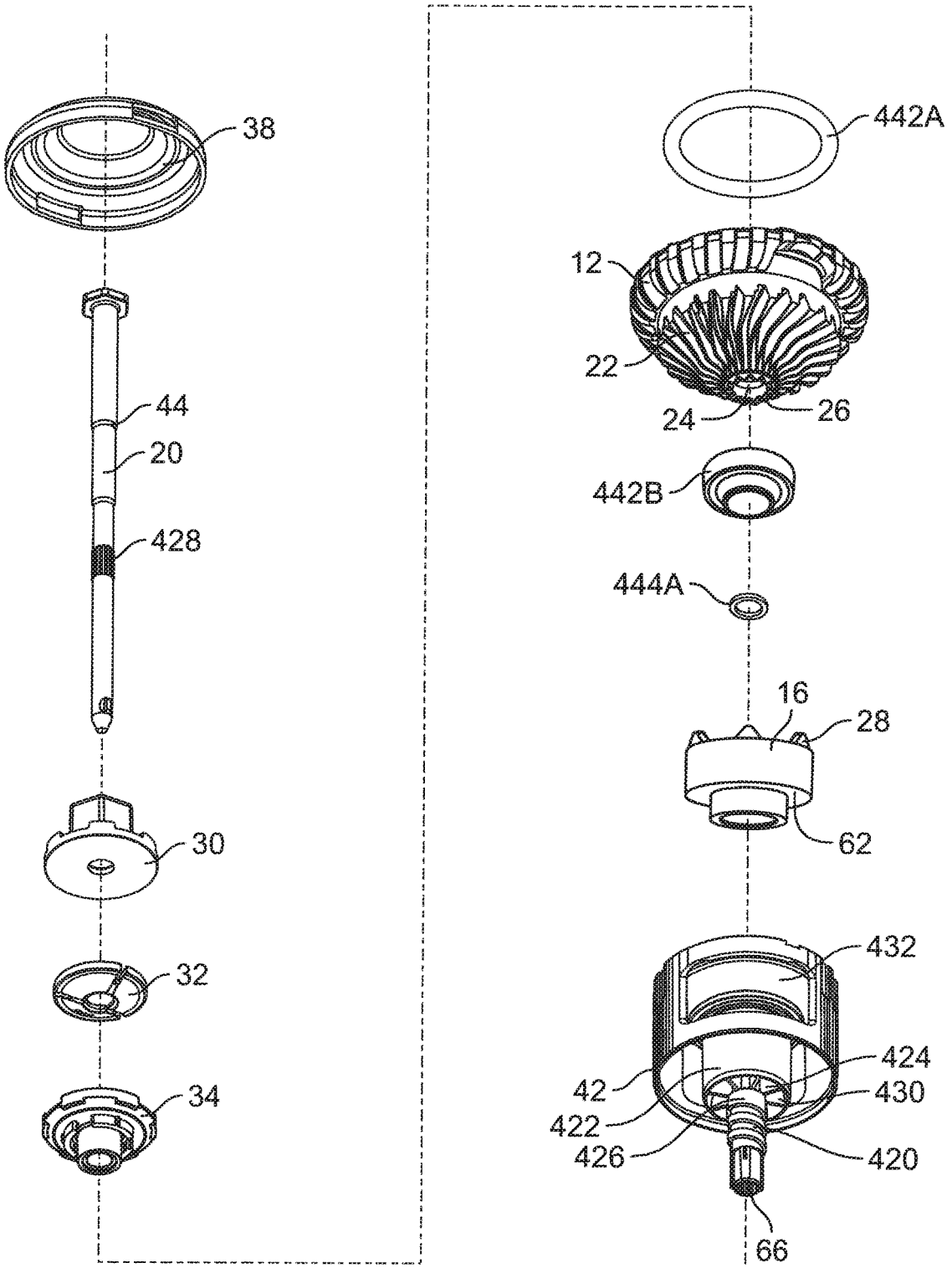
FIGS. 4A and 4B are bottom exploded perspective views of the nozzle of FIG. 1.

The rotatable deflector 12 has an underside surface that is preferably contoured to deliver a plurality of fluid streams generally radially outwardly. As shown in FIG. 4A, the underside surface of the deflector 12 includes an array of flutes 22. The flutes 22 subdivide the water into the plurality of relatively small water streams which are distributed radially outwardly to surrounding terrain as the deflector 12 rotates. The flutes 22 define a plurality of intervening flow channels extending upwardly and radially outwardly with various selected inclination angles. During operation of the nozzle 10, the upwardly directed water impinges upon the lower or upstream segments of these flutes 22, which subdivide the water flow into the plurality of relatively small flow streams for passage through the flow channels and radially outward projection from the nozzle 10. As addressed further below, depending on the type of strip pattern (left corner, right corner, or side strip), a deflector with flutes 22 curving in either a clockwise or a counter-clockwise direction is preferably used.

The deflector 12 has a bore 24 for insertion of a shaft 20 therethrough. As can be seen in FIG. 4A, the bore 24 is preferably defined at its lower end by circumferentially-arranged, downwardly-protruding teeth 26. As described further below, these teeth 26 are sized to engage corresponding teeth 28 preferably disposed on the valve sleeve 16. This engagement allows a user to depress the deflector 12, so that the deflector teeth 26 and valve sleeve teeth 28 engage, and then to rotate the entire nozzle 10. The engagement of deflector 12 and valve sleeve 16 preferably aids installation of the nozzle 10 in a spray body/water source by rotating the deflector 12 and nozzle body 17 together via this engagement.

The deflector 12 also preferably includes a speed control brake to control the rotational speed of the deflector 12. In one preferred form shown in FIGS. 2, 3A, and 4A, the speed control brake includes a friction disk 30, a brake pad 32, and a seal retainer 34. The friction disk 30 preferably has an internal surface for engagement with a top surface on the shaft 20 so as to fix the friction disk 30 against rotation. The seal retainer 34 is preferably welded to, and rotatable with, the deflector 12 and, during operation of the nozzle 10, is urged against the brake pad 32, which, in turn, is retained against the friction disk 30. Water is directed upwardly and strikes the deflector 12, pushing the deflector 12 and seal retainer 34 upwards and causing rotation. In turn, the rotating seal retainer 34 engages the brake pad 32, resulting in frictional resistance that serves to reduce, or brake, the rotational speed of the deflector 12. Speed brakes like the type shown in U.S. Pat. No. 9,079,202 and U.S. Publication No. 2018/0141060, which are assigned to the assignee of the present application and are incorporated herein by reference in their entirety, are preferably used. Although the speed control brake is shown and preferably used in connection with nozzle 10 described and claimed herein, other brakes or speed reducing mechanisms are available and may be used to control the rotational speed of the deflector 12.

The deflector 12 is supported for rotation by shaft 20. Shaft 20 extends along a central axis of the nozzle 10, and the deflector 12 is rotatably mounted on an upper end of the shaft 20. As can be seen from FIG. 2, the shaft 20 extends through the bore 24 in the deflector 12 and through aligned bores in the friction disk 30, brake pad 32, and seal retainer 34, respectively. A cap 38 is mounted to the top of the deflector 12. The cap 38 prevents grit and other debris from coming into contact with the components in the interior of the deflector 12, such as the speed control brake components, and thereby hindering the operation of the nozzle 10.

Figure 2:
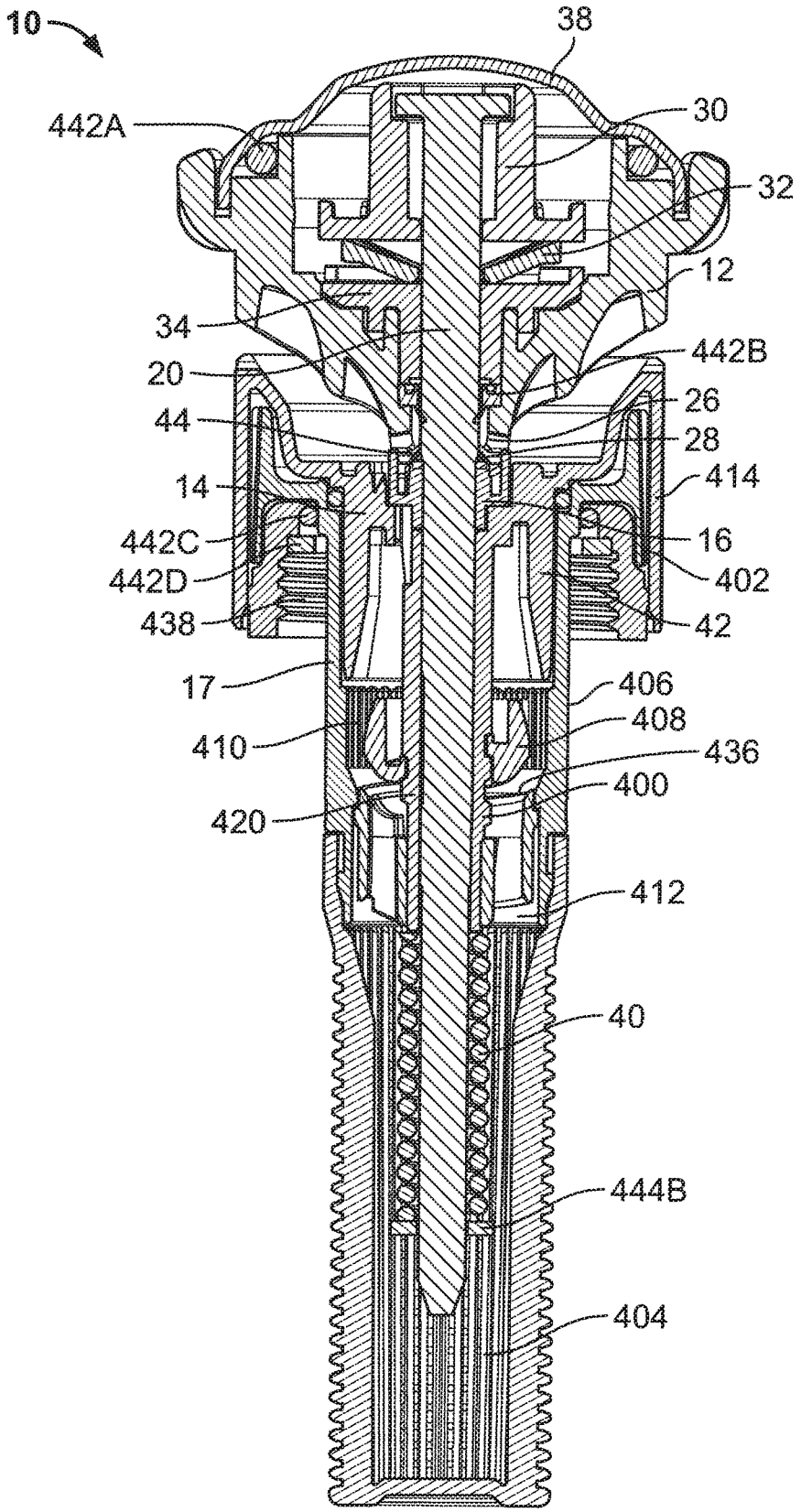
FIG. 2 is a cross-sectional view of the nozzle of FIG. 1.

A spring 40 mounted to the shaft 20 energizes and tightens the seal and engagement of the pattern template 14. More specifically, the spring 40 operates on the shaft 20 to bias the first of the two nozzle body portions that forms the valve 14 (valve sleeve 16) downwardly against the second portion (nozzle housing 42). By using a spring 40 to maintain a forced engagement between valve sleeve 16 and nozzle housing 42, the nozzle 10 provides a tight seal of the pattern template 14, concentricity of the valve 14, and a uniform jet of water directed through the valve 14. In addition, mounting the spring 40 at one end of the shaft 20 results in a lower cost of assembly. As can be seen in FIG. 2, the spring 40 is mounted near the lower end of the shaft 20 and downwardly biases the shaft 20. In turn, the shaft shoulder 44 exerts a downward force on the washer/retaining ring 444A and valve sleeve 16 for pressed fit engagement with the nozzle housing 42.

Figure 3A:
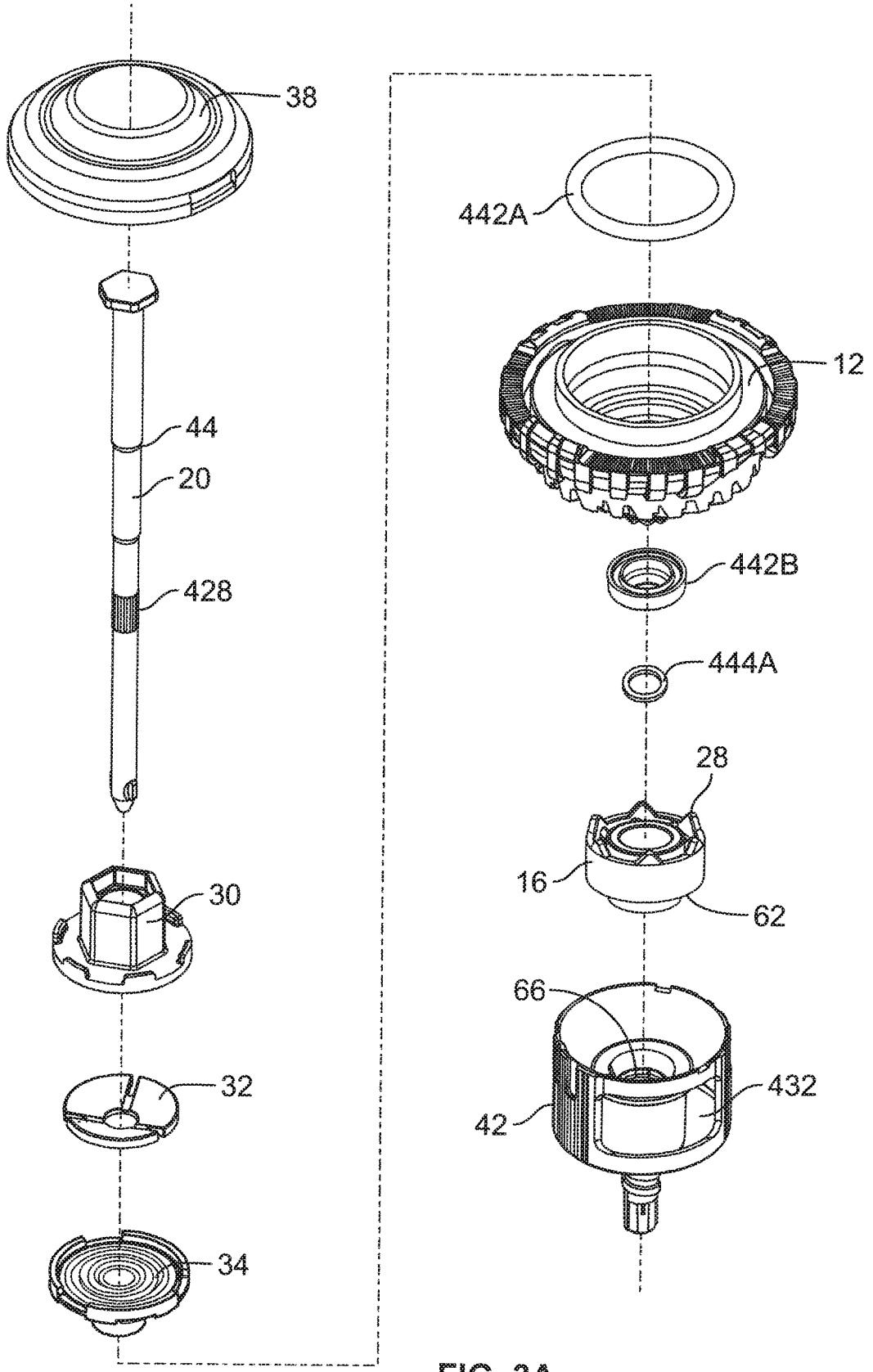
FIGS. 3A and 3B are top exploded perspective views of the nozzle of FIG. 1.

The template 14 preferably includes two bodies that interact with one another to determine the strip setting: the valve sleeve 16 and the nozzle housing 42. As shown in FIGS. 2, 3A, and 4A, the valve sleeve 16 is generally cylindrical in shape and, as described above, includes a top surface with teeth 28 for engagement with corresponding teeth 26 of the deflector 12. When the user depresses the deflector 12, the two sets of teeth engage, and the user may then rotate the deflector 12 to effect rotation of the rotate the entire nozzle 10, thereby facilitating installation of the nozzle 10 in a spray body. The valve sleeve 16 also includes a central bore 46 for insertion of the shaft 20 therethrough.

The valve sleeve 16 and nozzle housing 42 are shown in FIGS. 5, 6A, 6B, and 6C and are described further below. As shown in the figures, the nozzle housing 42 includes a cylindrical recess 63 that receives and supports the valve sleeve 16 therein. The nozzle housing 42 has a central hub 64 that defines a central bore 66 that receives the shaft 20, which further supports the valve sleeve 16. The central hub 64 includes a support surface 68 to engage and support the bottom surface of the valve sleeve 16.

The nozzle housing 42 also has a circumferential ledge 70 to allow an annular lip 62 of the valve sleeve 16 to seal therealong. The ledge 70 engages and provides additional support to the valve sleeve 16. The ledge 70 extends along the entire circumference of the valve sleeve 16, and as addressed below, defines an inner edge of the discharge orifices formed by the flow channels 74. The nozzle housing 42 also preferably includes one or more spacing members 71 to space the valve sleeve 16 from the nozzle housing, and in this example, there are three spacing members 71 that are arranged at about 90 degree intervals. The spacing members 71 can take the form of axially extending ribs.

Figure 5:
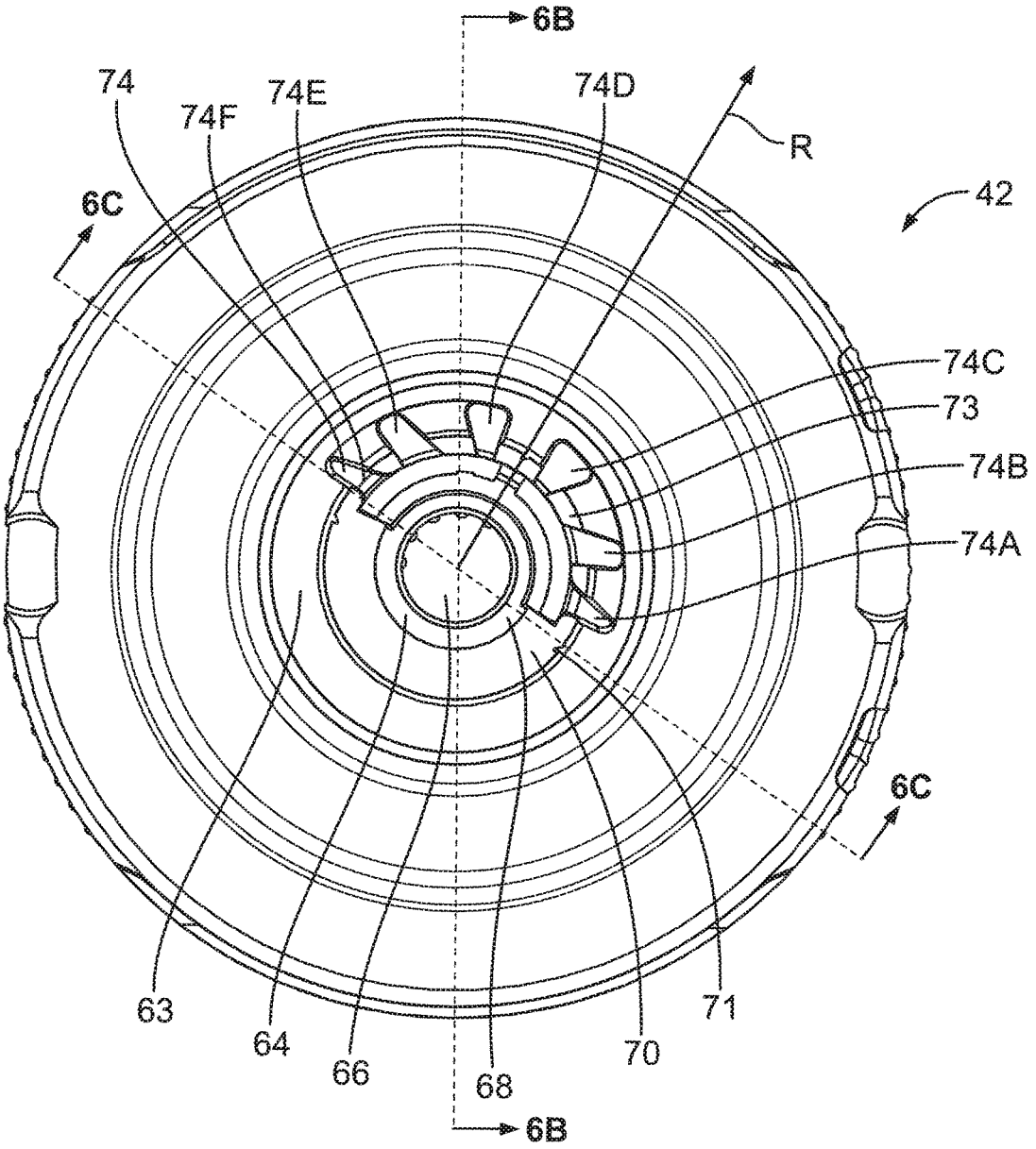
FIG. 5 is a top plan view of an unassembled valve sleeve and nozzle housing of the nozzle of FIG. 1.
Figure 5:
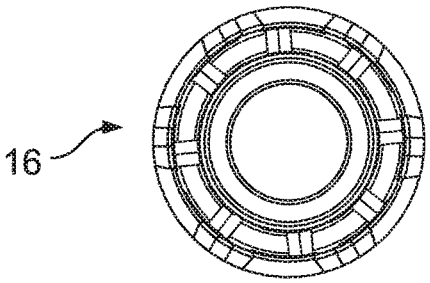
Figure 6A:
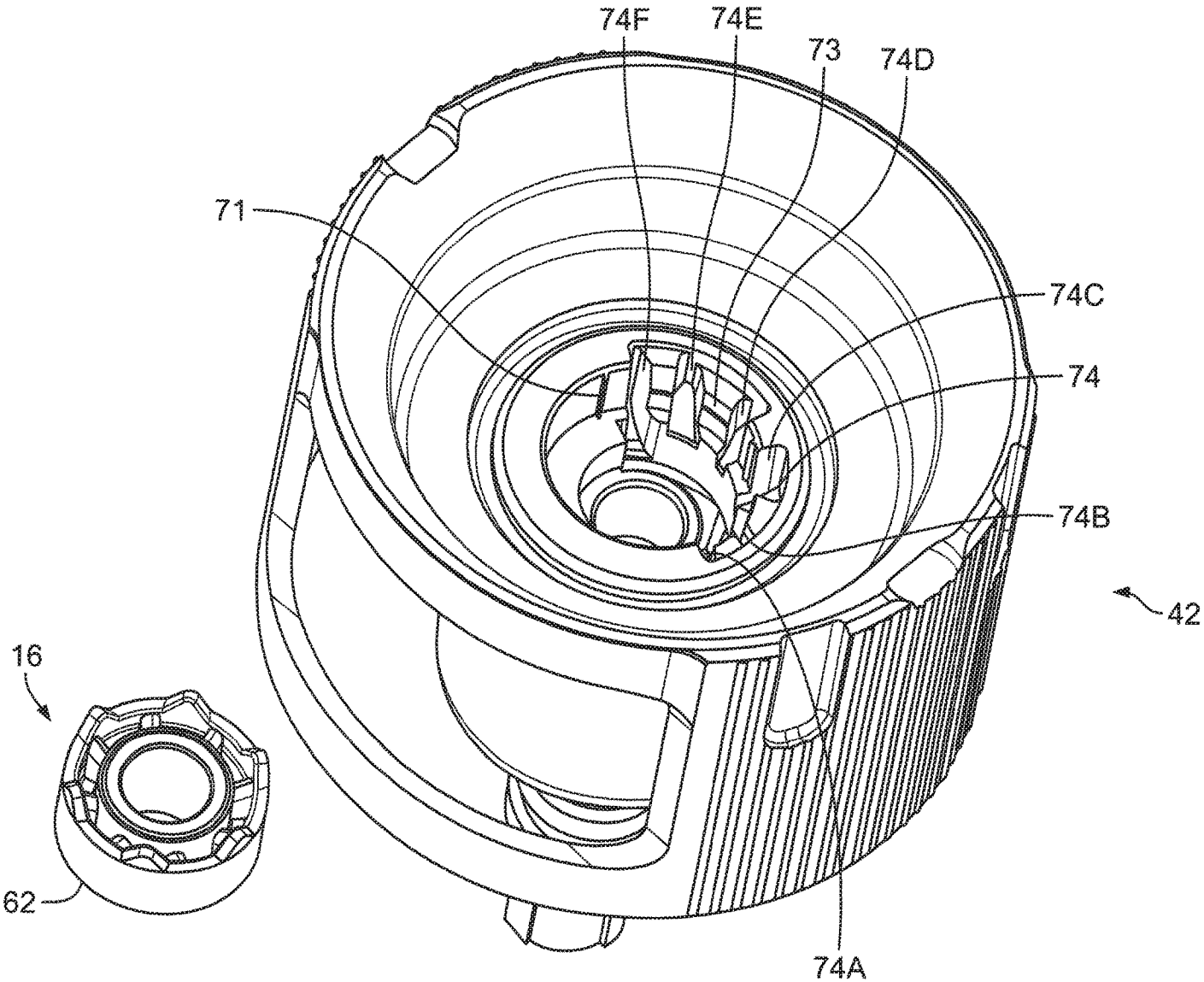
FIG. 6A is a top perspective view of the unassembled valve sleeve and nozzle housing of the nozzle of FIG. 5.
Figure 6B:
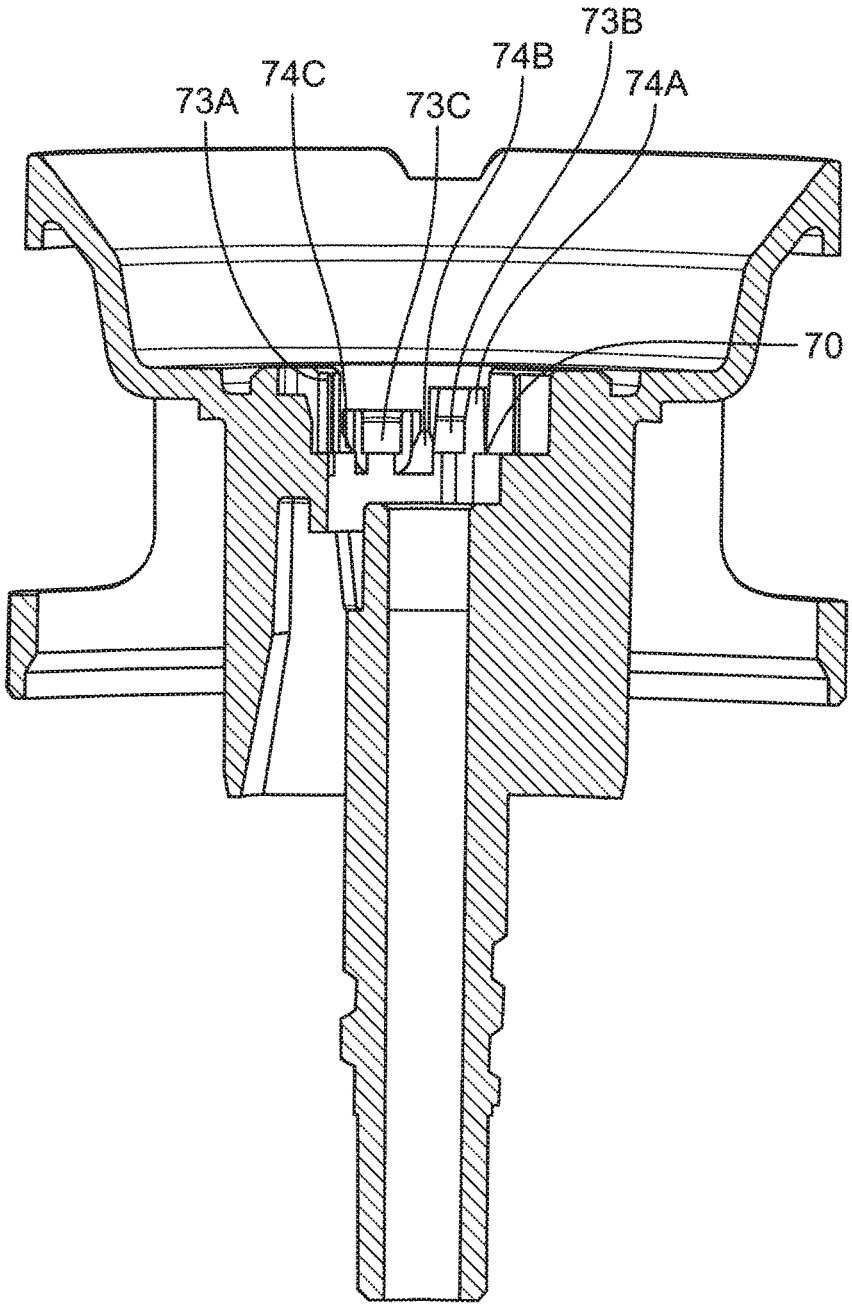
FIG. 6B is a cross-sectional view of the nozzle housing shown in FIG. 5 taken along the line 6B-6B.
Figure 6C:
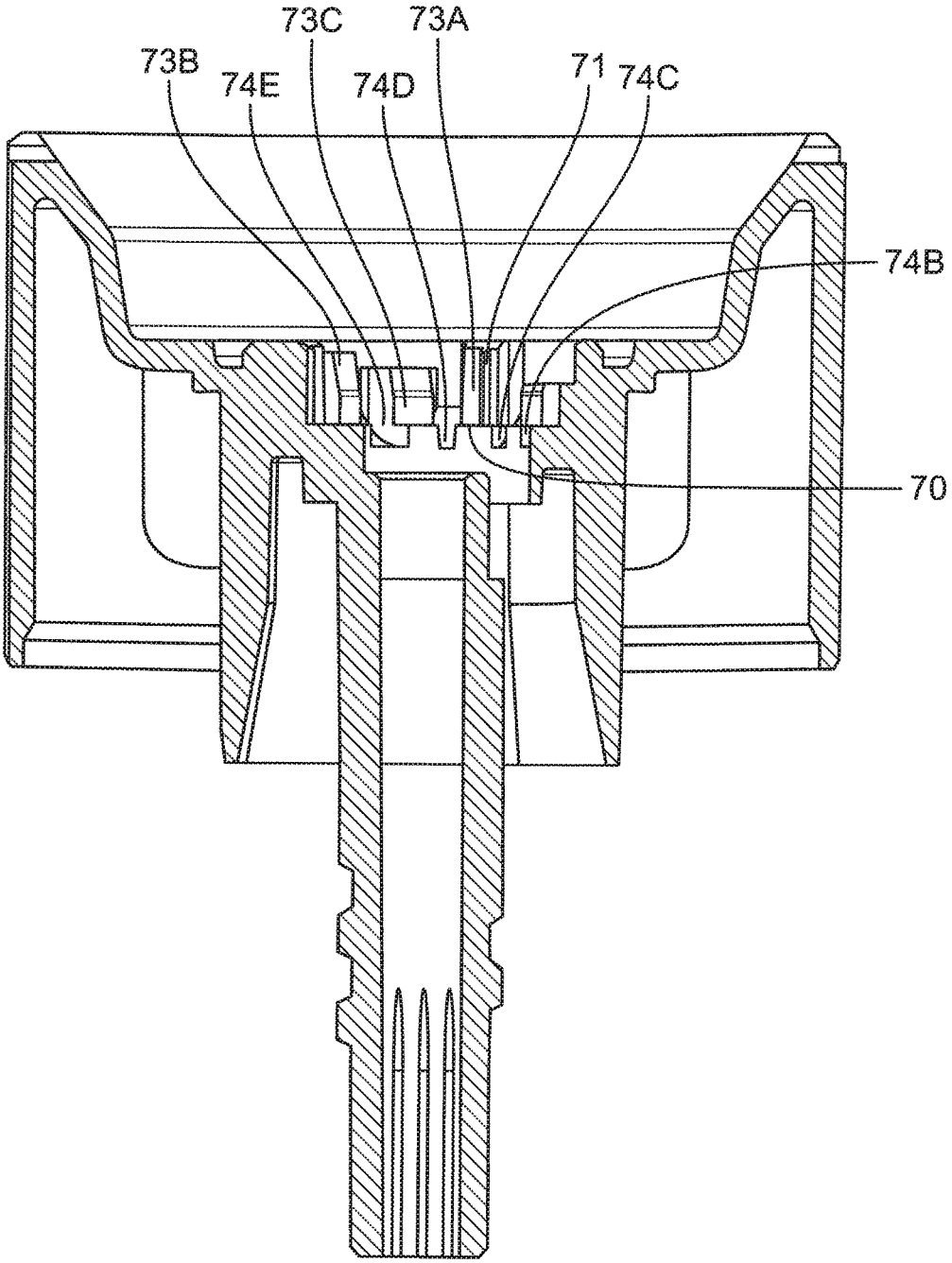
FIG. 6C is a cross-sectional view of the nozzle housing shown in FIG. 5 taken along the line 6C-6C.
Figure 7:
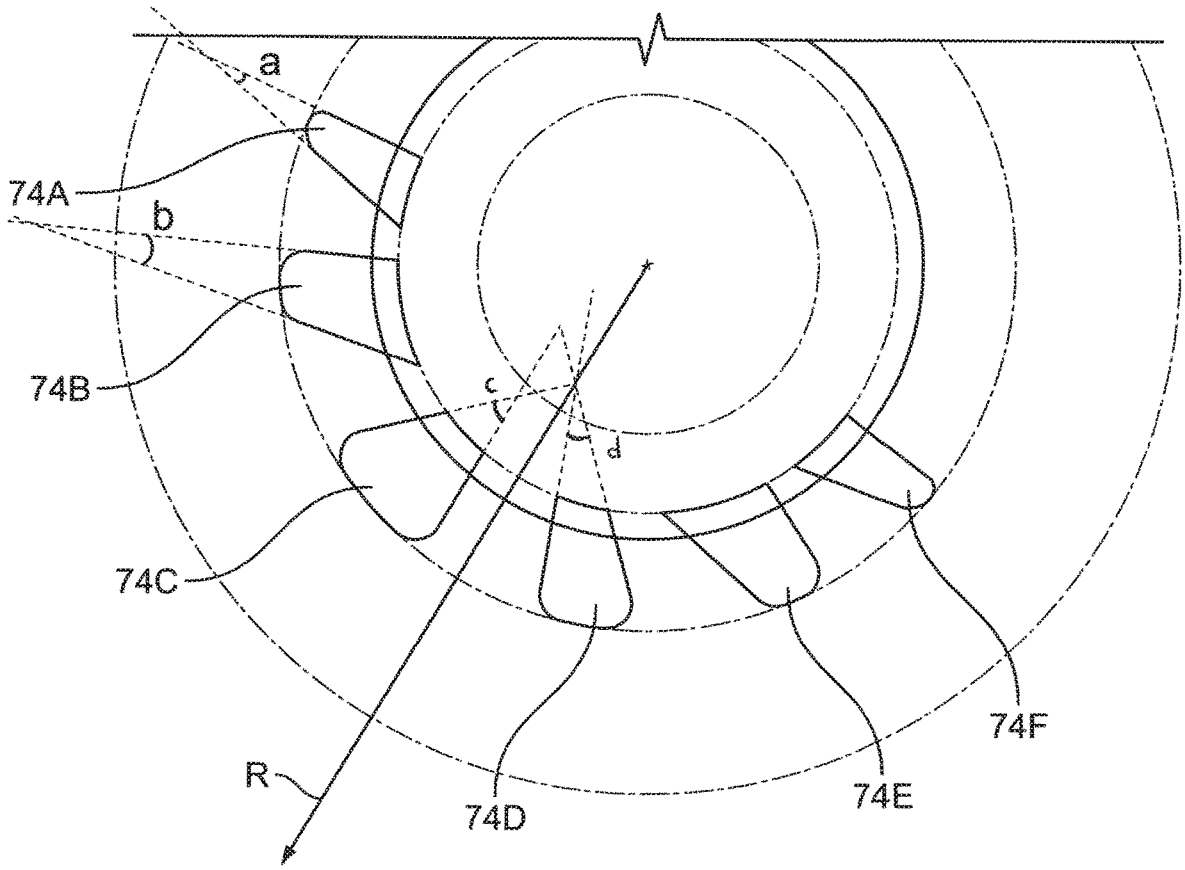
FIG. 7 is a schematic representation of a nozzle housing of the nozzle of FIG. 1 showing the geometry of six flow channels for side strip irrigation.

The nozzle housing 42 includes six flow channels 74 that fill in various parts of a side strip irrigation pattern, i.e., a rectangular irrigation pattern that extends to both sides of the nozzle 10. As can be seen in FIGS. 5-7, the six flow channels 74A, 74B, 74C, 74D, 74E, and 74F are arranged about the nozzle housing 42 to extend in a circumferential manner about half of the nozzle housing 42. The ribs 73 between the channels 74 are configured so that the outermost two flow channels 74A and 74F are longer than the other flow channels 74B, 74C, 74D, 74E. More specifically, the inlet ends of flow channels 74A and 74F are upstream of the other channels. Further, the ribs 73 between the flow channels are preferably of different heights such that the two sidewalls of each flow channel extends a different length downstream. In one preferred form, as can be seen in FIGS. 6B and 6C, the rib 73A between the middle flow channels 74C, 74D extends the furthest downstream, followed by the rib 73B between flow channels 74A and 74B (and between 74E and 74F), and followed by the rib 73C between flow channels 74B and 74C (and between 74D and 74E) extending the shortest distance downstream. The six flow channels are configured to collectively fill in different portions of the rectangular irrigation pattern.

Further, as shown in FIGS. 5-7, the six flow channels 74A, 74B, 74C, 74D, 74E, and 74F do not all have the same cross-sectional shapes and geometries. Preferably, the outermost two flow channels (74A and 74F) are essentially mirror images of one another (or symmetric) about a radial line R. The radial line R generally extends directly in front of the nozzle with respect to the configuration shown in FIGS. 12A-C and 13-C. In this preferred form, the two sidewalls of each flow channel 74A and 74F define an angle a (e.g., about 16.5 degrees) with respect to one another. The sidewalls are separated by a curved wall have a predetermined radius of curvature, such as, for example, 0.14650 inches. The intermediate two flow channels (74B and 74E) are also preferably mirror images of one another (or symmetric) about the radial line R. In this preferred form, the two sidewalls of each flow channel 74B and 74E define an angle b (e.g., about 15 degrees) with respect to one another. The sidewalls are separated by two curved walls of a predetermined radius of curvature (e.g., 0.010 inches) on each side of a linear segment.

In contrast, the two inner flow channels (74C and 74D) define different shapes with respect to one another. In this preferred form, the two sidewalls of flow channel 74C define an angle c of about 35.2 degrees with respect to one another. The sidewalls diverge away from one another at their outer ends. Flow channel 74D, however, is skewed to one side, and its sidewalls preferably define a predetermined angle d, such as, for example, an angle of about 25 degrees. Flow channel 74D is skewed away from radial line R so as to direct more fluid flow in a direction opposite the clockwise rotation of the deflector 12. More specifically, the sidewalls of flow channel 74D are oriented to direct fluid away from the radial line R to a greater degree than are the sidewalls of flow channel 74C. In this preferred form, the outer end of flow channel 74D is skewed to direct fluid flowing through the flow channel 74D away from fluid flowing through flow channel 74C and opposite the clockwise rotation of the deflector 12.

In this particular example, the two innermost flow channels 74C, 74D are asymmetric with respect to one another, while the outermost flow channels 74A, 74F and the intermediate flow channels 74B, 74E are symmetric with respect to one another. As addressed further below, however, it is contemplated that there are certain advantages associated with asymmetric flow channels. Accordingly, it is contemplated that one or both of the outermost flow channels 74A, 74F and the intermediate flow channels 74B, 74E may also be asymmetric in order to better fill out certain portions of the irrigation pattern (in addition to the innermost flow channels 74C, 74D). Further, it is also contemplated that it may be desirable, in some circumstances, that one or both of the outermost flow channels 74A, 74F and the intermediate flow channels 74B, 74E be arranged in an asymmetric manner (while the innermost flow channels 74C, 74D are symmetric).

Figure 13A:
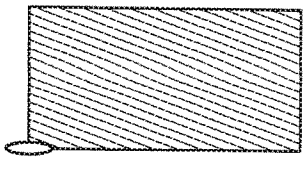
FIGS. 13A, 13B, and 13C are representational views of the irrigation patterns and coverage areas of the right corner strip, side strip, and left corner strip nozzles.
Figure 13B:
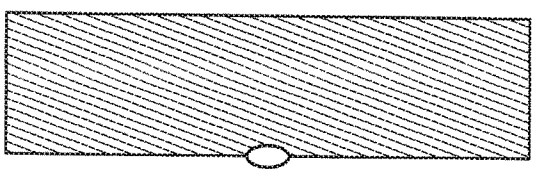

In the preferred form shown in FIGS. 5-7, it is believed that, without the asymmetry of flow channel 74D, fluid flowing through the flow channels 74C and 74D and impacting the deflector 12 will tend to merge creating one strong fluid stream and that the clockwise rotation of the deflector 12 will tend to shift this fluid stream to the right in the irrigation pattern (see FIG. 13B). Thus, it is believed this clockwise rotation of the deflector 12 may tend to result in less irrigation on the left side of the pattern. Due to Coriolis forces and rotational momentum, one aim is to create the required mass flow rate ahead of the targeted area of the pattern. Therefore, the flow channel to the left of center (74D) will be different from the flow channel to the right of center (74C). By skewing flow channel 74D to direct fluid in a more leftward direction, against the clockwise rotation of the deflector 12, it is believed that the two innermost streams will not merge and that the side strip irrigation pattern will be filled out more evenly (see FIG. 13B).

Accordingly, an objective is to design the individual flow channels 74A, 74B, 74C, 74D, 74E, 74F to provide the required mass flow rate of water ahead of the target area to be filled. If the mass flow rate is too low, there will not be sufficient mass of water for the rotational momentum to carry the water and insufficient watering has been found to occur. If the mass flow rate is too great, overthrow will occur. Proper sizing of the mass flow rate of water ahead of the target area ensures that the streams ahead of the target area will have sufficient mass of water to allow the rotational momentum to throw the water to the desired location.

The geometry of the flow channels 74A, 74B, 74C, 74D, 74E, 74F and the ribs 73 between the flow channels are configured to achieve this effect. Individual flow channel shapes can be converging or diverging to increase/decrease the velocity of the flow of a specific flow channel. In the same way, the size of the flow channel entrance (width and depth) can be larger or smaller to increase/decrease the flow rate of a specific flow channel. Individual rib shapes between the flow channels also form the flow streams. The widths of the ribs 73 determine if neighboring streams will merge. The heights of the ribs 73 determine at what point the streams separate from the nozzle housing and engage the deflector 12.

For example, in one preferred form shown in the figures, the outermost channels 74A, 74F and the intermediate channels 74B, 74E converge in the radially outward direction. On the other hand, the innermost channels 74C, 74D diverge in the radial outward direction. The cross-sectional area of the right innermost (center) channel 74C is preferably larger than the cross-sectional area of the left innermost (center) 75D. The cross-sectional area of the outermost channels 74A, 74F is preferably the same, and the cross-sectional area of the intermediate channels 74B, 74E is preferably the same. In one preferred form, the cross-sectional area of the outermost channels 74A, 74F is the smallest, followed by the center channel 74D, then followed by the intermediate channels 74B, 74E, and with center channel 74C having the largest cross-sectional area.

Due to the short throw in the very center of the rectangle, the left center channel 74D is designed to be skewed counterclockwise when viewed from above, in the opposite direction of rotation. This widens the center rib 73 preventing the flow of the left center channel 74D from merging with the flow of the right center channel 74C. Preventing the streams from merging reduces the potential for overthrow in the center of the rectangular pattern. The design of the left center channel 74D is also different from the right center channel 74C to provide sufficient mass of water ahead of the target area to allow the stream to provide complete coverage of the center of the rectangle.

As can be seen in FIG. 13B, the nozzle 10 is disposed at the midpoint of the longer leg of the rectangle with the shorter leg extending in front of the nozzle 10. In one preferred form, the side strip irrigation pattern defines a five foot by thirty foot rectangle with the pattern extending five feet in front of the nozzle and also extending fifteen feet to the left and fifteen feet to the right of the nozzle 10. Although a specific set of flow channels 74A, 74B, 74C, 74D, 74E, and 74F is described herein, it should be understood that a different number of flow channels may be used and that flow channels with other geometries are available such that fluid directed generally in a forward direction toward the short leg of the rectangle (in FIG. 13B) is directed "ahead of" (or in a more counterclockwise direction when viewed from above) to better fill in the left side of the pattern. So, for example, it is contemplated that four flow channels might be used (two sets/groups of two flow channels) or eight flow channels might be used (four sets of two flow channels), and it is further contemplated that one or more of these sets of flow channels may be selected to be asymmetric set(s) of flow channels.

Accordingly, the rotary nozzle 10 uses six flow channels 74A, 74B, 74C, 74D, 74E, and 74F to fill in a side strip irrigation pattern. As addressed further below, it is generally contemplated that left corner strip and right corner strip irrigation can be accomplished by removing or blocking three of the flow channels on one side or the other. It is contemplated that the uniformity of irrigation of the left corner strip or right corner strip patterns also can be improved by specifically matching the left corner strip and right corner strip nozzle housings with a deflector designed to rotate in the clockwise and counterclockwise directions, respectively.

So, in one preferred form, for example, assuming a clockwise rotating deflector 12, the three flow channels for each of the left and right corner strip nozzles may have shapes similar to those described above and shown in FIGS. 5 and 7. More specifically, as addressed further below, for a left corner strip nozzle, the nozzle may include three flow channels that are similar to flow channels 74A, 74B, and 74C (with the other three flow channels either removed or blocked). Then, for a right corner strip nozzle, the nozzle may include three flow channels that are similar to flow channels 74D, 74E, and 74F (with the other three flow channels either removed or blocked).

In this form, the flow channels of the right corner strip nozzle are not a mirror image of those for the left corner strip nozzle. The flow channels of the left corner strip and the right corner strip nozzles are different from one another because of the rotational momentum of the deflector 12. As addressed above, the angles defined by the sidewalls of flow channels 74C and 74D are different, and the relative position and angle to the center line of flow channels are different. Flow channel 74C provides additional flow ahead of the short streams that are being shut off. Again, this arrangement assumes a deflector 12 rotating in a clockwise direction for both types of corner strip nozzles. However, as addressed further below, in another form, it is contemplated that alternative flow channels may be used for the right corner strip nozzle by using a deflector rotating in the opposite direction, i.e., in a counterclockwise direction.

Figure 8:
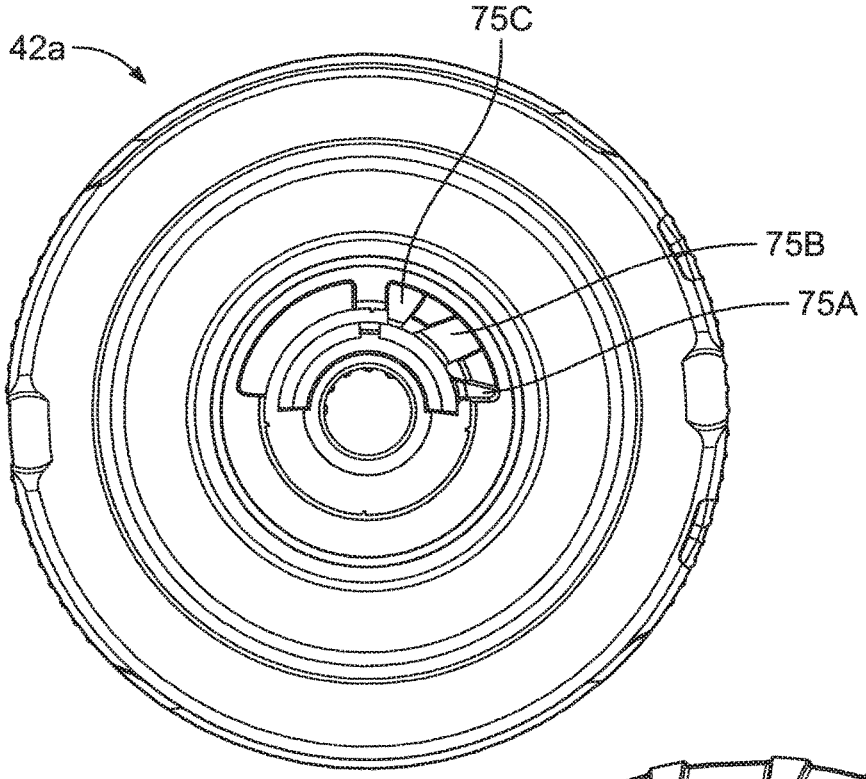
FIG. 8 is a top plan view of an alternative form of a nozzle housing for the nozzle of FIG. 1 for left corner strip irrigation.
Figure 9:
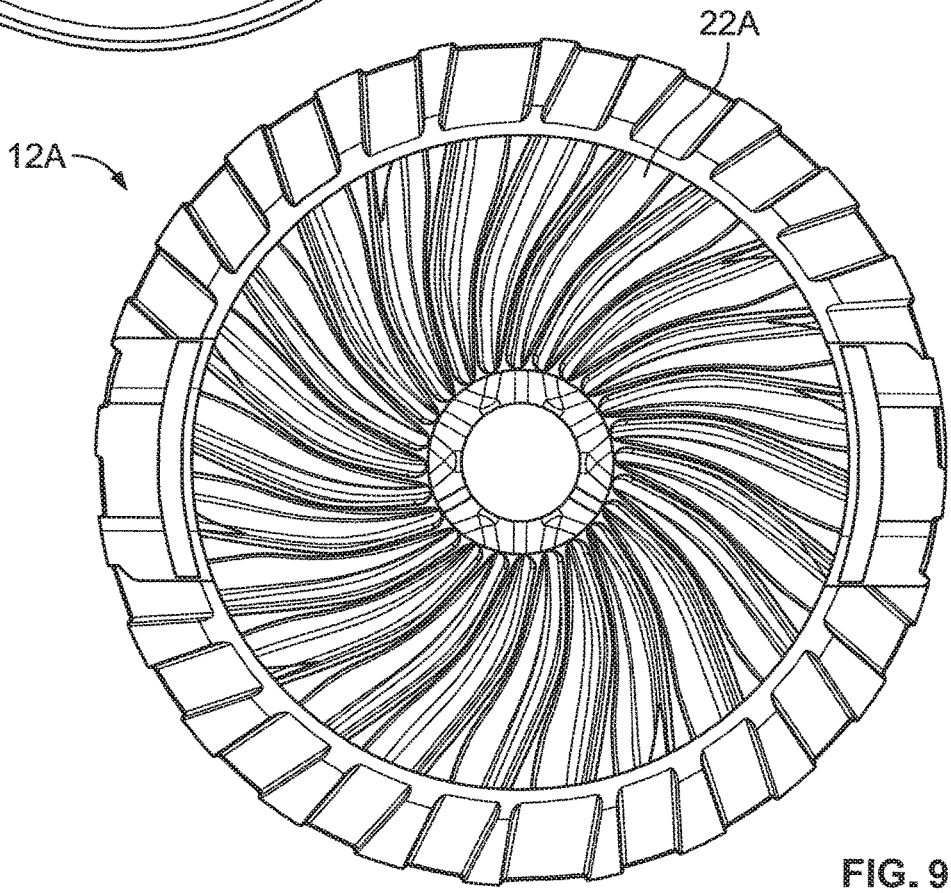
FIG. 9 is a bottom plan view of a deflector having flutes curving in a clockwise direction.

FIGS. 8 and 9 show the combination of a nozzle housing 42A and a deflector 12A that are preferably used for left corner strip irrigation. More specifically, in this preferred form, the nozzle is disposed at the bottom left corner of a rectangle, and the left corner strip rectangular pattern extends five feet forward of the nozzle and fifteen feet to the right of the nozzle (FIG. 13A). Given the position and geometry of the left corner strip rectangular pattern (with the longer leg of the rectangle extending to the right of the nozzle), it is desirable to combine the nozzle housing 42A with a deflector 12A having flutes 22A curving, at least in part, in a clockwise direction (when viewed from the underside of the nozzle) sufficient for driving clockwise rotation of the deflector 12A (when viewed from above the nozzle).

As can be seen in FIG. 8, the nozzle housing 42A preferably includes three flow channels 75A, 75B, and 75C (rather than the six flow channels of the side strip nozzle housing 42). These flow channels 75A, 75B, and 75C allow water to flow through the nozzle housing 42A on the right side of the nozzle housing 42A. In contrast, on the other side of the nozzle housing 42A, no flow channels are included. As can be seen, the three flow channels 75A, 75B, and 75C occupy one quadrant of the nozzle housing 42A (the top right quadrant).

In this preferred form, as addressed above, the two sidewalls of outermost flow channel 75A define an angle of about 16.5 degrees with respect to one another. Further, in this preferred form, the two sidewalls of the intermediate flow channel 75B define a predetermined angle, such as, for example, an angle of about 15 degrees with respect to one another. In addition, in this preferred form, the two sidewalls of the innermost flow channel 75C define an angle of about 28 degrees with respect to one another. In one preferred form, the three flow channels 75A, 75B, and 75C may have the same or similar geometry to flow channels 74A, 74B, and 74C, respectively, of the side strip nozzle housing 42. So, for example, in this preferred form, the flow channels 75A, 75B converge in the radially outward direction, whereas flow channel 75C diverges in the radial outward direction.

As can been in FIG. 9, the deflector 12A has flutes 22A that are curved, at least in part, in a clockwise direction (when viewing the bottom of the deflector 12A), thereby resulting in clockwise rotation of the deflector 12A (when viewed from the top of the nozzle). In this regard, the direction of flute curvature is the same as in deflector 12 (for side strip irrigation), and in one preferred form, deflector 12 and deflector 12A are the same. It is believed that the clockwise rotation of the deflector 12 tends to whip the exiting water streams in the direction of the long leg of the rectangle, i.e., to the right in FIG. 13A. This whipping effect is believed to be more pronounced for longer throw streams that tend to have more mass and volume than the shorter throw streams to the shorter leg of the rectangle. Accordingly, a clockwise rotating deflector 12A tends to fill in the long throw corners of the pattern more completely (relative to a deflector rotating in the other direction) and results in a clean, crisp pattern. As should be understood, although one preferred form of a deflector 12A is shown, it is generally contemplated that any of various other types of deflectors may be used that have clockwise curvature along at least a portion of some of the deflector flutes sufficient to drive the deflector 12A in a clockwise direction. For example, in one form, the deflector could consist of an arrangement of curved flutes and straight flutes. Also, the deflector might even include a few flutes with a reverse, counterclockwise curvature, as long as the remaining flutes are sufficient to drive the deflector 12A in a clockwise direction.

Next, in one preferred form, for example, assuming a clockwise rotating deflector 12 or 12A, the three flow channels for a right corner strip nozzle may have shapes similar to those described above and shown in FIGS. 5 and 7. More specifically, for a right corner strip nozzle, the nozzle may include three flow channels that are similar to flow channels 74D, 74E, and 74F (with the other three flow channels either removed or blocked). In this form, the flow channels of the left corner strip and the right corner strip nozzles are different from one another because of the rotational momentum resulting from the clockwise rotating deflector 12 or 12A. However, in an alternative form, as addressed below, it is contemplated that alternative flow channels may be used for the right corner strip nozzle by matching the flow channels with a deflector rotating in a counterclockwise direction.

Figure 10:
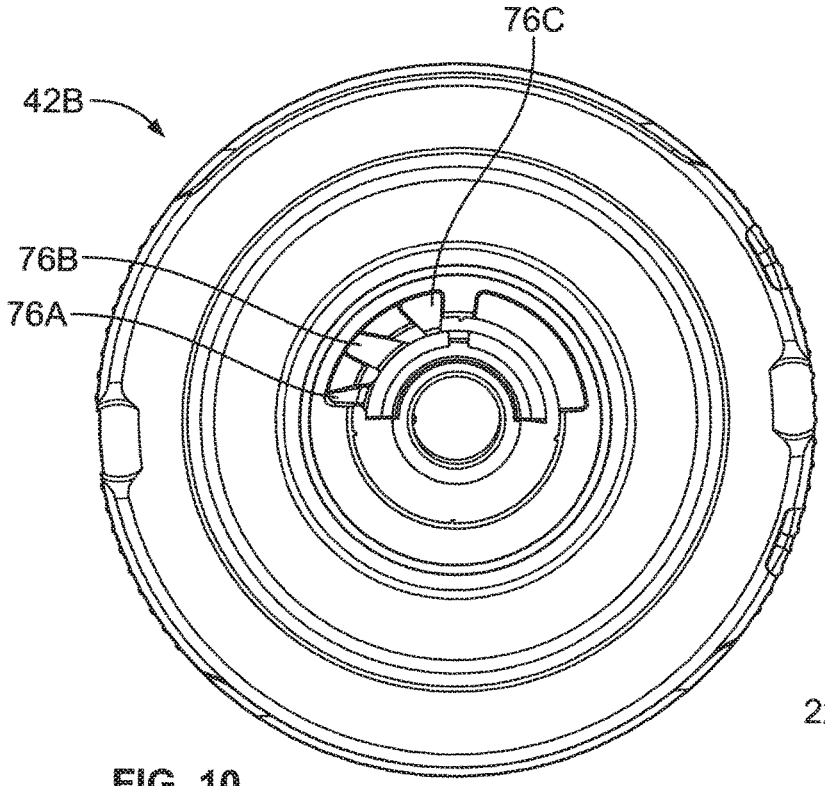
FIG. 10 is a top plan view of an alternative form of a nozzle housing for the nozzle of FIG. 1 for right strip irrigation.
Figure 11:
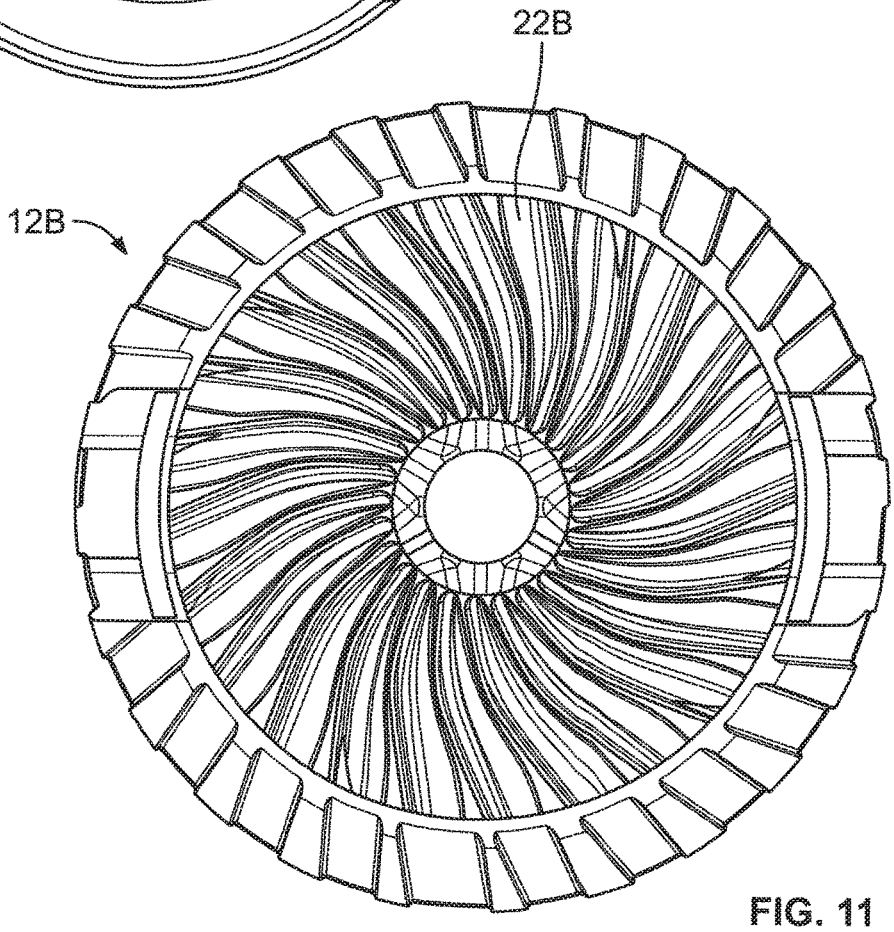
FIG. 11 is a bottom plan view of a deflector having flutes curving in a counterclockwise direction.

More specifically, in this alternative form, FIGS. 10 and 11 show the combination of a nozzle housing 42B and a deflector 12B that may be used for right corner strip irrigation. In this preferred form, the nozzle is disposed at the bottom right corner of a rectangle (FIG. 13C), and in one preferred form, the right corner strip rectangular pattern extends five feet forward of the nozzle and fifteen feet to the left of the nozzle. Given the position and geometry of the right corner strip rectangular pattern (with the longer leg of the rectangle extending to the left of the nozzle), it is desirable to combine the nozzle housing 42B with a deflector 12B having flutes 42B curving, at least in part, in a counterclockwise direction (when viewed from the underside of deflector 12B) sufficient for driving counterclockwise rotation of the deflector 12B (when viewed from above the nozzle).

As can be seen in FIG. 10, the nozzle housing 42B preferably includes three flow channels 76A, 76B, and 76C. These flow channels 76A, 76B, and 76C allow water to flow through the nozzle housing 42B on the left side of the nozzle housing 42B. In contrast, on the other side of the nozzle housing 42B, flow channels are not included. As can be seen, the three flow channels 76A, 76B, and 76C occupy one quadrant of the nozzle housing 42A (the top left quadrant).

As can been in FIG. 11, the deflector 12B has flutes that are curved, at least in part, in a counterclockwise direction (when viewing the underside of the deflector 12B), thereby resulting in counterclockwise rotation of the deflector 12B (when viewed from the top of the nozzle). In this regard, the direction of flute curvature is opposite the curvature of deflector 12 (for side strip irrigation) and deflector 12A (for left corner strip irrigation). It is believed that the counterclockwise rotation of the deflector 12B tends to whip the exiting water streams in the direction of the long leg of the rectangle, i.e., to the left in FIG. 13C. As stated above, this whipping effect is believed to be more pronounced for longer throw streams that tend to have more mass and volume than the shorter throw streams to the shorter leg of the rectangle. Accordingly, a counterclockwise rotating deflector 12B tends to fill in the long throw corners of the pattern more completely (relative to a deflector rotating in the other (clockwise) direction). As should be understood, although one preferred form of a deflector 12B is shown, it is generally contemplated that any of various other types of deflectors may be used that have counterclockwise curvature along at least a portion of some of the deflector flutes sufficient to drive the deflector 12B in a counterclockwise direction. For example, in one form, the deflector could consist of an arrangement of curved flutes and straight flutes (and might also include a few flutes with a reverse, clockwise curvature).

Thus, it is contemplated that the uniformity of irrigation can be improved by specifically matching the left corner strip and right corner strip nozzle housings 42A, 42B with the direction of rotation of the deflector. More specifically, this matching makes use of the Coriolis effect and the rotational momentum affecting the long throw streams, which require greater mass and volume of water than short streams. When the long streams are shut off, there is sufficient mass of water in the channels that the rotational momentum results in a whipping action of the streams. This whipping action fills out the pattern, and this effect is not present when shutting off the short streams. By using a deflector 12A rotating in a clockwise direction, the left corner strip nozzle benefits from this effect by filling out the long throw corners of the pattern.

In contrast, when a deflector 12A rotating in the same direction (a clockwise direction) is used with the right corner strip nozzle housing 42B, this nozzle then suffers from the Coriolis effect. Filling out the long throw corners of the right corner strip pattern is difficult. The rotational momentum whips the stream away from the initial corner of the pattern making it difficult to fill out the pattern.

Accordingly, when a deflector 12A rotating in a clockwise direction is used for both types of nozzles, the left corner strip nozzle has a cleaner crisper pattern. By utilizing the counterclockwise rotating deflector 12B with the right corner strip nozzle housing 42B, this nozzle then also benefits from the Coriolis effect and rotational momentum to the same extent as the left corner strip nozzle housing 42A utilizing a clockwise rotating deflector 12A. Although a specific set of three flow channels is described herein for left corner strip and for right corner strip irrigation, it should be understood that a different number of flow channels and that flow channels with other geometries are available that can be matched with the direction of rotation of the deflector to fill in the target areas. So, for example, it is contemplated that two flow channels or four flow channels may be used in the left corner strip and right corner strip nozzles.

Figure 12A:
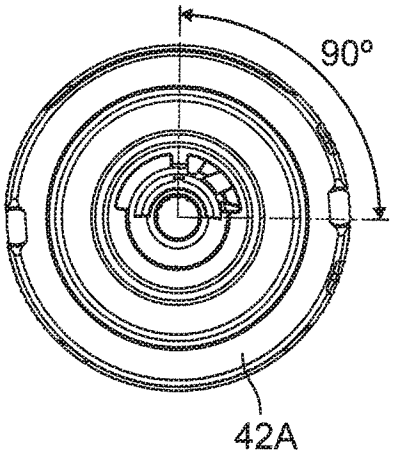
FIGS. 12A, 12B, and 12C are top plan views of the nozzle housings for right corner strip, side strip, and left corner strip irrigation.
Figure 12B:
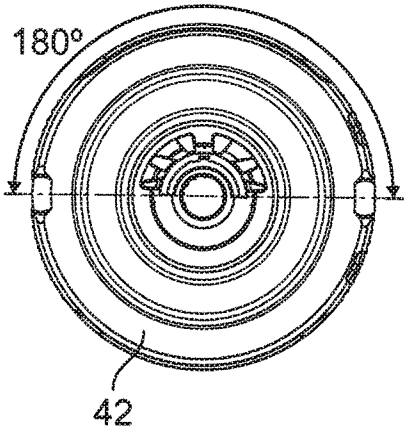
Figure 12C:
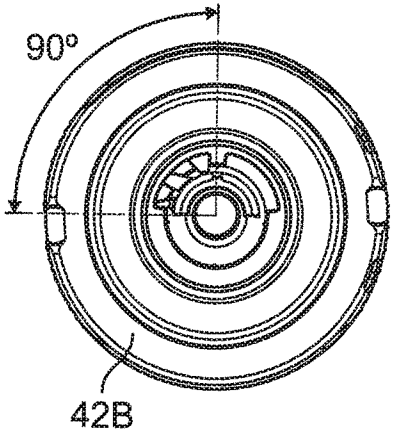
Figure 13C:
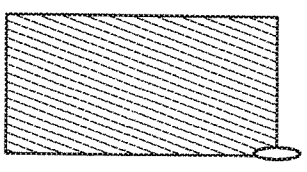

FIGS. 12A-C and 13A-C show the alignment of the nozzle 10 for different strip irrigation patterns. FIG. 12A shows a nozzle housing 42A used in a left corner strip nozzle, and FIG. 13A shows the resulting left corner strip rectangular pattern. FIG. 12B shows a nozzle housing 42 used in a side strip nozzle, and FIG. 13B shows the resulting side strip rectangular irrigation pattern. FIG. 12C shows a nozzle housing 42B used in a right corner strip nozzle, and FIG. 13C shows the resulting left corner strip rectangular pattern.

In one form, it is contemplated that the side strip, left corner strip, and right corner strip nozzles may be distributed and/or used individually to address specific irrigation needs. In another form, however, it is contemplated that two or more of these specialty nozzles may be distributed and/or used as part of a kit. For example, it may be desirable to distribute both left corner and right corner strip nozzles as part of a kit so that the user can more conveniently address different irrigation areas relative to the position of the nozzle. As an additional example, for additional convenience, the kit may include all three models—side strip, left corner strip, and right corner strip nozzles.

As shown in FIG. 2, the nozzle 10 also preferably include a radius control valve 400. The radius control valve 400 can be used to selectively set the volume of fluid flowing through the nozzle 10 for purposes of regulating the range of throw of the projected water streams. It is adapted for variable setting through use of a rotatable segment 402 located on an outer wall portion of the nozzle 10. It functions as a valve that can be opened or closed to varying degrees to control the flow of water through the nozzle 10. Also, a filter 404 is preferably located upstream of the radius control valve 400, so that it obstructs passage of sizable particulate and other debris that could otherwise clog or damage the nozzle components or compromise desired efficacy of the nozzle 10.

The radius control valve 400 allows the user to set the relative dimensions of the side, left, and right rectangular strips. In one preferred form, the nozzle 10 irrigates a 5 foot by 30 foot side strip area and a 5 foot by 15 foot left and right corner strip area, when the radius control valve 400 is fully open. The user may then adjust the valve 400 to reduce the throw radius, which variably decreases the size of the rectangular area being irrigated but maintains the proportionate sizes of the legs of the rectangle.

As shown in FIGS. 2-4B, the radius control valve structure preferably includes a nozzle collar 406 and a flow control member 408 for use with any of the nozzles, nozzle housings, and valve sleeves disclosed herein. The nozzle collar 406 is rotatable about the central axis of the nozzle 10. It has an internal engagement surface 410 and engages the flow control member 408 so that rotation of the nozzle collar 406 results in rotation of the flow control member 408. The flow control member 408 also engages the nozzle housing 42, 42A, 42B such that rotation of the flow control member 408 causes the member 408 to move in an axial direction, as described further below. In this manner, rotation of the nozzle collar 406 can be used to move the flow control member 408 helically in an axial direction closer to and further away from an inlet 412. When the flow control member 408 is moved closer to the inlet 412, the throw radius is reduced. The axial movement of the flow control member 408 towards the inlet 412 increasingly pinches the flow through the inlet 412. When the flow control member 408 is moved further away from the inlet 412, the throw radius is increased. This axial movement allows the user to adjust the effective throw radius of the nozzle 10 without disruption of the streams dispersed by the deflector 12, 12A, 12B.

As shown in FIGS. 2-4B, the nozzle collar 406 is preferably cylindrical in shape and includes an engagement surface 410, preferably a splined surface, on the interior of the cylinder. The nozzle collar 406 preferably also includes an outer wall 414 having an external grooved surface for gripping and rotation by a user. Water flowing through the inlet 412 passes through the interior of the cylinder and through the remainder of the nozzle body 17 to the deflector 12, 12A, 12B. Rotation of the outer wall 414 causes rotation of the entire nozzle collar 406.

Figure 3B:
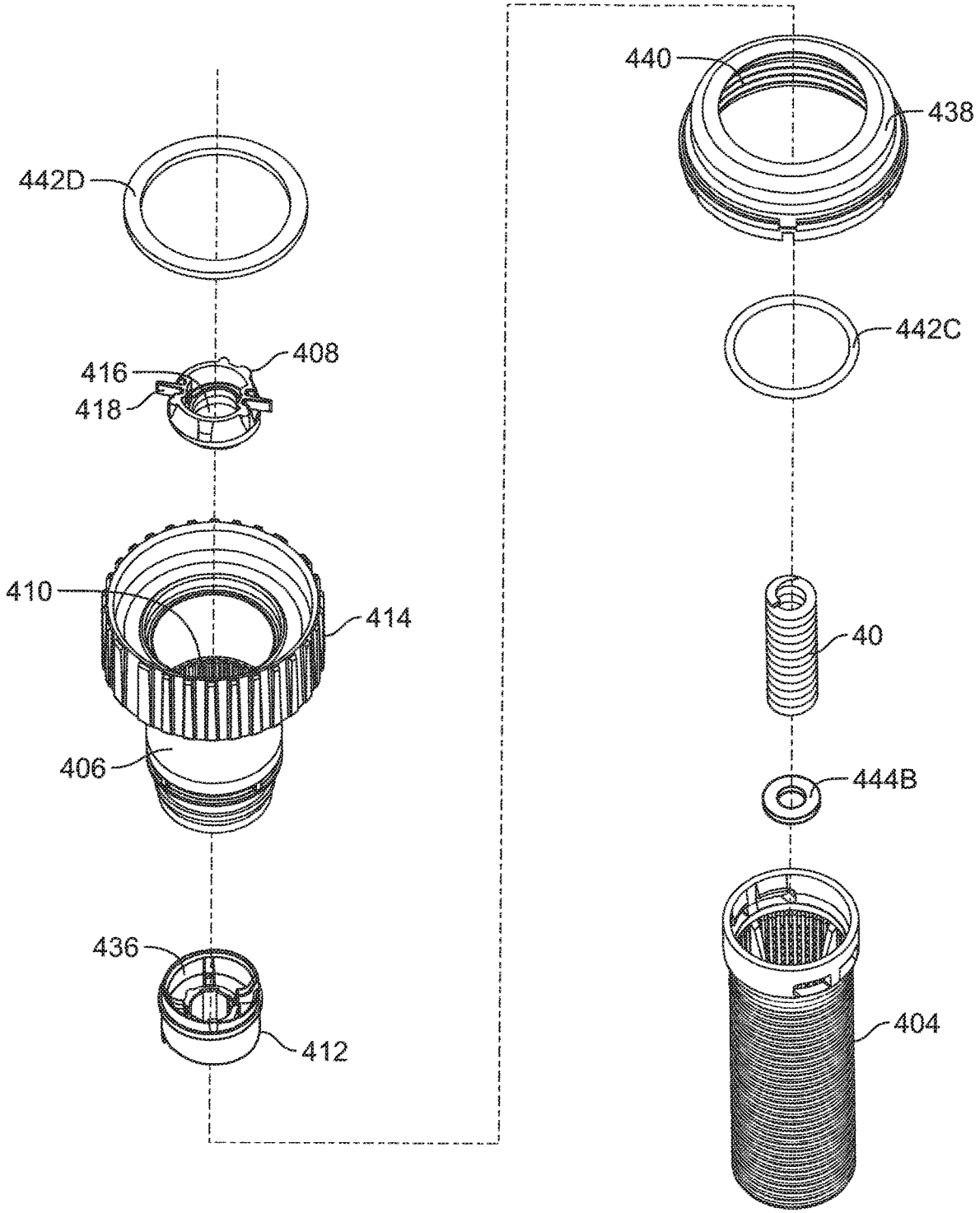
Figure 4B:
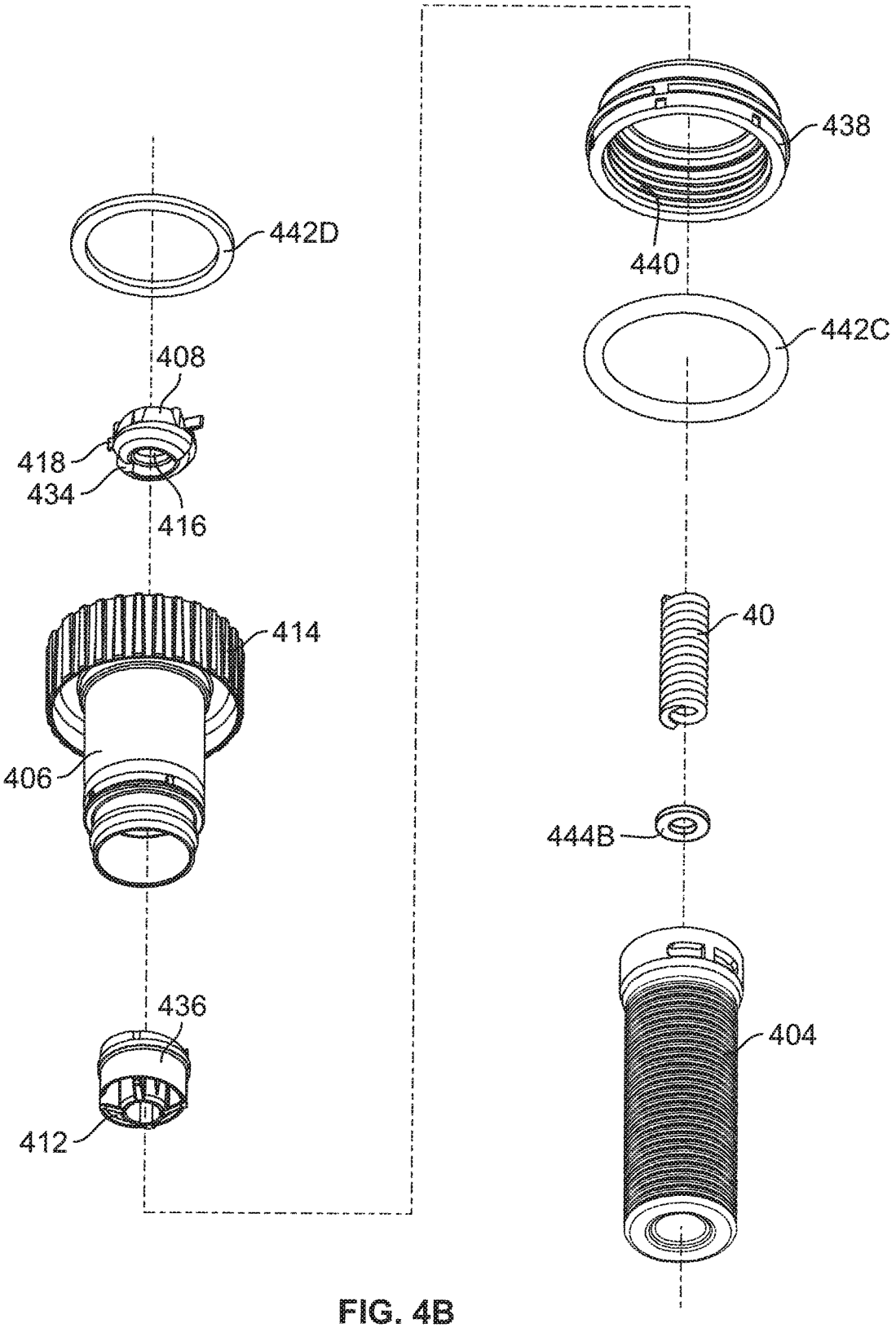

The nozzle collar 406 is coupled to the flow control member 408 (or throttle body). As shown in FIGS. 3B and 4B, the flow control member 408 is preferably in the form of a ring-shaped nut with a central hub defining a central bore 416. The flow control member 408 has an external surface with two thin tabs 418 extending radially outward for engagement with the corresponding internal splined surface 410 of the nozzle collar 406. The tabs 418 and internal splined surface 410 interlock such that rotation of the nozzle collar 406 causes rotation of the flow control member 408 about the central axis.

In turn, the flow control member 408 is coupled to the nozzle housing 42, 42A, 42B. More specifically, the flow control member 408 is internally threaded for engagement with an externally threaded hollow post 420 at the lower end of the nozzle housing 42, 42A, 42B. Rotation of the flow control member 408 causes it to move along the threading in an axial direction. In one preferred form, rotation of the flow control member 408 in a counterclockwise direction advances the member 408 towards the inlet 412 and away from the deflector 12, 12A, 12B. Conversely, rotation of the flow control member 408 in a clockwise direction causes the member 408 to move away from the inlet 412. Although threaded surfaces are shown in the preferred embodiment, it is contemplated that other engagement surfaces could be used to effect axial movement.

The nozzle housing 42, 42A, 42B preferably includes an outer cylindrical wall 422 joined by spoke-like ribs 424 to an inner cylindrical wall 426. The inner cylindrical wall 426 preferably defines the bore 66 to accommodate insertion of the shaft 20 therein. The inside of the bore 66 is preferably splined to engage a splined surface 428 of the shaft 20 and fix the shaft 20 against rotation. The lower end forms the external threaded hollow post 420 for insertion in the bore 416 of the flow control member 408, as discussed above. The ribs 424 define flow passages 430 to allow fluid flow upwardly through the remainder of the nozzle 10.

In operation, a user may rotate the outer wall 414 of the nozzle collar 406 in a clockwise or counterclockwise direction. As shown in FIGS. 3A and 4A, the nozzle housing 42, 42A, 42B preferably includes one or more cut-out portions 432 to define one or more access windows to allow rotation of the nozzle collar outer wall 414. Further, as shown in FIG. 2, the nozzle collar 406, flow control member 408, and nozzle housing 42, 42A, 42B are oriented and spaced to allow the flow control member 408 to essentially block fluid flow through the inlet 412 or to allow a desired amount of fluid flow through the inlet 412. The flow control member 408 preferably has a helical bottom surface 434 for engagement with a valve seat 436 (preferably having a helical top surface).

Rotation in a counterclockwise direction results in helical movement of the flow control member 408 in an axial direction toward the inlet 412. Continued rotation results in the flow control member 408 advancing to the valve seat 436 formed at the inlet 412 for blocking fluid flow. The dimensions of the radial tabs 418 of the flow control member 408 and the splined internal surface 410 of the nozzle collar 406 are preferably selected to provide over-rotation protection. More specifically, the radial tabs 418 are sufficiently flexible such that they slip out of the splined recesses upon over-rotation. Once the inlet 412 is blocked, further rotation of the nozzle collar 406 causes slippage of the radial tabs 418, allowing the collar 406 to continue to rotate without corresponding rotation of the flow control member 408, which might otherwise cause potential damage to nozzle components.

Rotation in a clockwise direction causes the flow control member 408 to move axially away from the inlet 412. Continued rotation allows an increasing amount of fluid flow through the inlet 412, and the nozzle collar 406 may be rotated to the desired amount of fluid flow. When the valve is open, fluid flows through the nozzle 10 along the following flow path: through the inlet 412, between the nozzle collar 406 and the flow control member 408, through the nozzle housing 42, 42A, 42B, through the valve sleeve 16, to the underside surface of the deflector 12, 12A, 12B, and radially outwardly from the deflector 12, 12A, 12B. It should be evident that the direction of rotation of the outer wall 414 for axial movement of the flow control member 408 can be easily reversed, i.e., from clockwise to counterclockwise or vice versa, such as by changing the direction of the threading.

The nozzle 10 also preferably include a nozzle base 438 of generally cylindrical shape with internal threading 440 for quick and easy thread-on mounting onto a threaded upper end of a riser with complementary threading (not shown). The nozzle base 438 and nozzle housing 42, 42A, 42B are preferably attached to one another by welding, snap-fit, or other fastening method such that the nozzle housing 42, 42A, 42B is stationary relative to the base 438 when the base 438 is threadedly mounted to a riser. The nozzle 10 also preferably include seal members 442A, 442B, 442C, 442D, such as o-rings, at various positions, as shown in FIG. 2, to reduce leakage. The nozzle 10 also preferably includes retaining rings or washers 444A, 444B disposed at the top of valve sleeve 16 (preferably for engagement with shaft shoulder 44) and near the bottom end of the shaft 20 for retaining the spring 40.

The radius adjustment valve 400 and certain other components described herein are preferably similar to that described in U.S. Pat. Nos. 8,272,583 and 8,925,837, which are assigned to the assignee of the present application and are incorporated herein by reference in their entirety. Generally, in this preferred form, the user rotates a nozzle collar 406 to cause a throttle nut 408 to move axially toward and away from the valve seat 436 to adjust the throw radius. Although this type of radius adjustment valve 400 is described herein, it is contemplated that other types of radius adjustment valves may also be used.

Accordingly, in one form, there is disclosed a strip nozzle comprising: a deflector rotatable about a central axis and having an upstream surface contoured to deliver fluid radially outwardly therefrom to a coverage area; a pattern template upstream of the deflector and defining a plurality of flow channels; wherein the plurality of flow channels directs fluid against the deflector and outwardly therefrom to define a rectangular coverage area; wherein the plurality of flow channels comprises a first set of flow channels including two flow channels, the two flow channels being asymmetric with respect to one another about a radial line extending from the central axis.

In some implementations, in the strip nozzle, the plurality of flow channels comprises a second set of channels including two flow channels, the two flow channels of the second set being symmetric with respect to one another about the radial line. In some implementations, the plurality of flow channels comprises a third set of channels including two flow channels, the two flow channels of the third set being symmetric with respect to one another about the radial line. In some implementations, the first set of flow channels are configured to direct fluid against the deflector and outwardly therefrom a first, relatively short distance; the second set of flow channels are configured to direct fluid against the deflector and outwardly therefrom a second, relatively long distance; and the third set of flow channels are configured to direct fluid against the deflector and outwardly therefrom a third, relatively intermediate distance; the first distance being less than the second and third distances and the third distance being less than the second distance. In some implementations, the rectangular coverage area defines a short leg and a long leg, the short leg extending in front of the nozzle and the long leg extending to each side of the nozzle. In some implementations, the length of each of the flow channels of the second set is longer than the length of each of the flow channels of the first and third sets. In some implementations, each flow channel of the first set of flow channels is defined, at least in part, by a pair of sidewalls, each one of the pair of sidewalls extending a different distance downstream than the other sidewall of the pair. In some implementations, each of three sets of flow channels includes an inlet, the inlets of the second set of flow channels being upstream of the inlets of the first and third sets of flow channels. In some implementations, one of the two flow channels of the first set is skewed with respect to the other of the two flow channels in a direction opposite the direction of rotation of the deflector, sidewalls of the one flow channel being oriented to direct fluid away from the radial line R to a greater degree than are sidewalls of the other flow channel. In some implementations, the pattern template comprises a first body in engagement with a second body, the second body defining, at least in part, the plurality of flow channels.

In another form, there is disclosed a corner strip nozzle comprising: a deflector having an underside surface including a plurality of flutes contoured to cause rotation of the deflector about a central axis when fluid impacts the underside surface and to redirect the fluid away from the underside surface in a plurality of streams to a coverage area; a pattern template upstream of the deflector and defining a plurality of flow channels; wherein the plurality of flow channels directs fluid against the deflector and outwardly therefrom to define a rectangular coverage area, the rectangular coverage area, when viewed from above, including a short leg extending in a first, forward direction from the nozzle and a long leg extending in a second, leftward direction from the nozzle such that the nozzle is disposed at a right corner of the rectangular coverage area; and wherein the plurality of flutes are curved, at least in part, in a counterclockwise direction when viewing the underside surface of the deflector so as to cause counterclockwise rotation of the deflector when viewed from above.

In another form, there is disclosed a kit including a right corner strip nozzle and a left corner strip nozzle, the kit comprising: a right corner strip nozzle including: a first deflector having an underside surface including a plurality of flutes contoured to cause rotation of the first deflector about a central axis when fluid impacts the underside surface and to redirect the fluid away from the underside surface in a plurality of streams to a first coverage area; a right corner strip pattern template upstream of the first deflector and defining a plurality of flow channels; wherein the plurality of flow channels directs fluid against the first deflector and outwardly therefrom to define a first rectangular coverage area, the first rectangular coverage area, when viewed from above, including a short leg extending in a forward direction from the nozzle and a long leg extending in a leftward direction from the nozzle such that the nozzle is disposed at a right corner of the first rectangular coverage area; wherein the plurality of flutes are curved, at least in part, in a counterclockwise direction when viewing the underside surface of the first deflector so as to cause counterclockwise rotation of the first deflector when viewed from above; and a left corner strip nozzle including: a second deflector having an underside surface including a plurality of flutes contoured to cause rotation of the second deflector about a central axis when fluid impacts the underside surface and to redirect the fluid away from the underside surface in a plurality of streams to a second coverage area; a left corner strip pattern template upstream of the second deflector and defining a plurality of flow channels; wherein the plurality of flow channels directs fluid against the second deflector and outwardly therefrom to define a second rectangular coverage area, the second rectangular coverage area, when viewed from above, including a short leg extending in a forward direction from the nozzle and a long leg extending in a rightward direction from the nozzle such that the nozzle is disposed at a left corner of the second rectangular coverage area; and wherein the plurality of flutes are curved, at least in part, in a clockwise direction when viewing the underside surface of the second deflector so as to cause clockwise rotation of the second deflector when viewed from above. The kit may also include a side strip nozzle.

It will be understood that various changes in the details, materials, and arrangements of parts and components which have been herein described and illustrated in order to explain the nature of the nozzle may be made by those skilled in the art within the principle and scope of the nozzle as expressed in the appended claims. As one example, it is generally contemplated that the pattern templates and deflectors described herein may be used with other types of components. Furthermore, while various features have been described with regard to a particular embodiment or a particular approach, it will be appreciated that features described for one embodiment also may be incorporated with the other described embodiments.

What is claimed is:

1. A strip nozzle comprising:

a deflector rotatable about a central axis and having an upstream surface contoured to cause rotation of the deflector about the central axis when fluid impacts the upstream surface to deliver fluid radially outwardly therefrom to a coverage area;

a pattern template upstream of the deflector and defining a plurality of flow channels;

wherein the plurality of flow channels directs fluid against the deflector and outwardly therefrom to define a rectangular coverage area;

wherein the plurality of flow channels comprises a first set of flow channels including two flow channels, the two flow channels being asymmetric with respect to one another about a radial line extending from the central axis.

2. The strip nozzle of claim 1, wherein the plurality of flow channels comprises a second set of channels including two flow channels, the two flow channels of the second set being symmetric with respect to one another about the radial line.

3. The strip nozzle of claim 2, wherein the plurality of flow channels comprises a third set of channels including two flow channels, the two flow channels of the third set being symmetric with respect to one another about the radial line.

4. The strip nozzle of claim 3, wherein:

the first set of flow channels are configured to direct fluid against the deflector and outwardly therefrom a first, relatively short distance;

the second set of flow channels are configured to direct fluid against the deflector and outwardly therefrom a second, relatively long distance; and the third set of flow channels are configured to direct fluid against the deflector and outwardly therefrom a third, relatively intermediate distance;

the first distance being less than the second and third distances and the third distance being less than the second distance.

5. The strip nozzle of claim 4, wherein the rectangular coverage area defines a short leg and a long leg, the short leg extending in front of the nozzle and the long leg extending to each side of the nozzle.

6. The strip nozzle of claim 5, wherein the length of each of the flow channels of the second set is longer than the length of each of the flow channels of the first and third sets.

7. The strip nozzle of claim 6, wherein each flow channel of the first set of flow channels is defined, at least in part, by a pair of sidewalls, each one of the pair of sidewalls extending a different distance downstream than the other sidewall of the pair.

8. The strip nozzle of claim 6, wherein each of three sets of flow channels includes an inlet, the inlets of the second set of flow channels being upstream of the inlets of the first and third sets of flow channels.

9. The strip nozzle of claim 1, wherein one of the two flow channels of the first set is skewed with respect to the other of the two flow channels in a direction opposite a direction of rotation of the deflector, sidewalls of the one flow channel being oriented to direct fluid away from the radial line R to a greater degree than are sidewalls of the other flow channel.

10. The strip nozzle of claim 1, wherein the pattern template comprises a first body in engagement with a second body, the second body defining, at least in part, the plurality of flow channels.

11. A corner strip nozzle comprising:

a deflector having an underside surface including a plurality of flutes contoured to cause rotation of the deflector about a central axis when fluid impacts the underside surface and to redirect the fluid away from the underside surface in a plurality of streams to a coverage area;

a pattern template upstream of the deflector and defining a plurality of flow channels;

wherein the plurality of flow channels directs fluid against the deflector and outwardly therefrom to define a rectangular coverage area, the rectangular coverage area, when viewed from above, including a short leg extending in a first, forward direction from the nozzle and a long leg extending in a second, leftward direction from the nozzle such that the nozzle is disposed at a right corner of the rectangular coverage area; and wherein the plurality of flutes are curved, at least in part, in a counterclockwise direction when viewing the underside surface of the deflector so as to cause counterclockwise rotation of the deflector when viewed from above.

12. The corner strip nozzle of claim 11, wherein the plurality of flow channels comprises three flow channels.

13. The corner strip nozzle of claim 12, wherein:

the first flow channel is configured to direct fluid against the deflector and outwardly therefrom a first, relatively long distance;

the second flow channel is configured to direct fluid against the deflector and outwardly therefrom a second, relatively short distance; and the third flow channel is configured to direct fluid against the deflector and outwardly therefrom a third, relatively intermediate distance;

the first distance being greater than the second and third distances and the third distance being greater than the second distance.

14. The corner strip nozzle of claim 12, wherein the length of the first flow channel is longer than the length of the second and third flow channels.

15. The corner strip nozzle of claim 11, wherein the pattern template comprises a first body in engagement with a second body, the second body defining, at least in part, the plurality of flow channels.

16. The corner strip nozzle of claim 15, wherein the plurality of channels are disposed within one quadrant of the second body.

17. A kit including a right corner strip nozzle and a left corner strip nozzle, the kit comprising:

a right corner strip nozzle comprising:

a first deflector having an underside surface including a plurality of flutes contoured to cause rotation of the first deflector about a central axis when fluid impacts the underside surface and to redirect the fluid away from the underside surface in a plurality of streams to a first coverage area;

a right corner strip pattern template upstream of the first deflector and defining a plurality of flow channels;

wherein the plurality of flow channels directs fluid against the first deflector and outwardly therefrom to define a first rectangular coverage area, the first rectangular coverage area, when viewed from above, including a short leg extending in a forward direction from the nozzle and a long leg extending in a leftward direction from the nozzle such that the nozzle is disposed at a right corner of the first rectangular coverage area;

wherein the plurality of flutes are curved, at least in part, in a counterclockwise direction when viewing the underside surface of the first deflector so as to cause counterclockwise rotation of the first deflector when viewed from above; and a left corner strip nozzle comprising:

a second deflector having an underside surface including a plurality of flutes contoured to cause rotation of the second deflector about a central axis when fluid impacts the underside surface and to redirect the fluid away from the underside surface in a plurality of streams to a second coverage area;

a left corner strip pattern template upstream of the second deflector and defining a plurality of flow channels;

wherein the plurality of flow channels directs fluid against the second deflector and outwardly therefrom to define a second rectangular coverage area, the second rectangular coverage area, when viewed from above, including a short leg extending in a forward direction from the nozzle and a long leg extending in a rightward direction from the nozzle such that the nozzle is disposed at a left corner of the second rectangular coverage area; and wherein the plurality of flutes are curved, at least in part, in a clockwise direction when viewing the underside surface of the second deflector so as to cause clockwise rotation of the second deflector when viewed from above.

18. The kit of claim 17, wherein the plurality of flow channels of each of the right and left corner strip nozzles comprises three flow channels.

19. The kit of claim 17, wherein each of the right corner strip and left corner strip pattern template comprises a first body nested within a second body, the second body defining, at least in part, the plurality of flow channels.

20. The kit of claim 17, wherein:

the plurality of channels of the right corner strip nozzle are disposed within a first quadrant of the second body of the right corner strip nozzle; and the plurality of channels of the left corner strip nozzle are disposed within a second, different quadrant of the second body of the left corner strip nozzle.

21. The kit of claim 17, further comprising a side strip nozzle, the side strip nozzle comprising:

a third deflector rotatable about a central axis and having an upstream surface contoured to deliver fluid radially outwardly therefrom to a coverage area;

a side strip pattern template upstream of the third deflector and defining a plurality of flow channels;

wherein the plurality of flow channels directs fluid against the third deflector and outwardly therefrom to define a rectangular coverage area;

wherein the plurality of flow channels comprises a first set of flow channels including two flow channels, the two flow channels of the first set being asymmetric with respect to one another about a radial line extending from the central axis.

* * * * *